United States Patent [19]

Spector

[11] Patent Number: 4,509,190

[45] Date of Patent: Apr. 2, 1985

[54] EFFECTS BOX SYSTEM AND METHOD

[76] Inventor: Abner Spector, 250 174th St. #1904, Miama Beach, Fla. 33160

[21] Appl. No.: 536,368

[22] Filed: Sep. 27, 1983

Related U.S. Application Data

[63] Continuation-in-part of Ser. No. 479,869, Mar. 29, 1983, abandoned, which is a continuation of Ser. No. 150,813, May 19, 1980, Pat. No. 4,388,490.

[51] Int. Cl.[3] ..... H04R 3/12

[52] U.S. Cl. ..... 381/61; 381/77; 381/119; 381/123

[58] Field of Search ..... 84/1.24, DIG. 17, DIG. 29; 179/91 R, 98; 339/17 B, 17 M; 361/337, 339, 361, 390, 391, 393, 394, 395, 399, 412, 415; 381/11, 61, 62, 85, 101, 102, 118, 123

[56] References Cited

U.S. PATENT DOCUMENTS

| | | | |
|---|---|---|---|
| 3,270,253 | 8/1966 | Binder et al. | 361/391 |
| 3,482,147 | 12/1969 | Kersten | 361/390 |
| 3,767,974 | 10/1973 | Donovan, Jr. et al. | 361/415 |
| 3,767,975 | 10/1973 | Glenn | 361/415 |
| 3,823,245 | 7/1974 | Suzuki | 84/1.24 |
| 3,842,212 | 10/1974 | Miller | 179/91 R |
| 3,858,091 | 12/1974 | Wilkinson | 361/390 |
| 4,012,610 | 3/1977 | Ericson et al. | 361/339 |
| 4,030,397 | 6/1977 | Nelson | 84/1.24 |
| 4,115,665 | 9/1978 | Giacoppo et al. | 179/98 |
| 4,176,251 | 11/1979 | Odlen et al. | 381/59 |
| 4,250,789 | 2/1981 | Tavel | 84/1.24 |
| 4,251,853 | 2/1981 | Sites | 361/394 |

*Primary Examiner*—Gene Z. Rubinson
*Assistant Examiner*—Randall P. Myers
*Attorney, Agent, or Firm*—David J. Harshman

[57] ABSTRACT

A method and a system for rapidly attaining a large number of different sounds in an audio signal processing system. A preferred embodiment comprises an audio signal processing system which includes a main housing, containing a main circuit apparatus, cartridge-receiving recesses, and cartridges fabricated to be removably received in the recesses, each cartridge containing an audio effects circuit which affects the signal in a unique way to provide a different sound output. A plurality of electrical contacts of the recess and cartridge respectively provide disengageable connection of the audio effects circuit to the system. In order to avoid the generation of spurious signals into the main signal path during the changing of a cartridge, and to maintain the uninterrupted flow of the main signal path through the system, switching means are connected such that the audio signal is noiselessly routed: flowing either to and from a recess via and through a cartridge therein, or passing by the recess to the next recess. Switching means are further provided for maintaining the continuity of the audio path while the recess is empty. The cartridges are inserted and removed producing, respectively, in the audio path, the quiet appearance and disappearance of the effect of its audio effects circuit. Panel-mounted switches and foot switches are provided to command bypass of any or all recesses whether said recess is devoid of a cartridge or contains a cartridge fully or otherwise installed therein.

65 Claims, 56 Drawing Figures

14
18
-5V
+5V
7
8
9
50K
10
1.5M
11
500K
4
D.P, D.J.
MOMENTARY
MAIN SIGNAL INCOMING
NC
#22 INPUT
#22 OUTPUT
MAIN SIGNAL
TO NEXT #4, (#2) OR OUT
S.P, S.T
NC
15
12
500K
6
100K
5
100K
100K
-9V
+9V
+18V

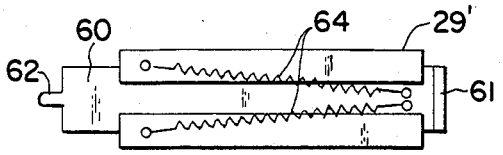
FIG. 10J
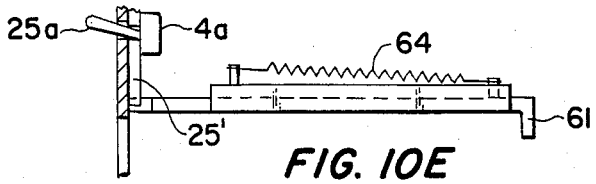
FIG. 10E
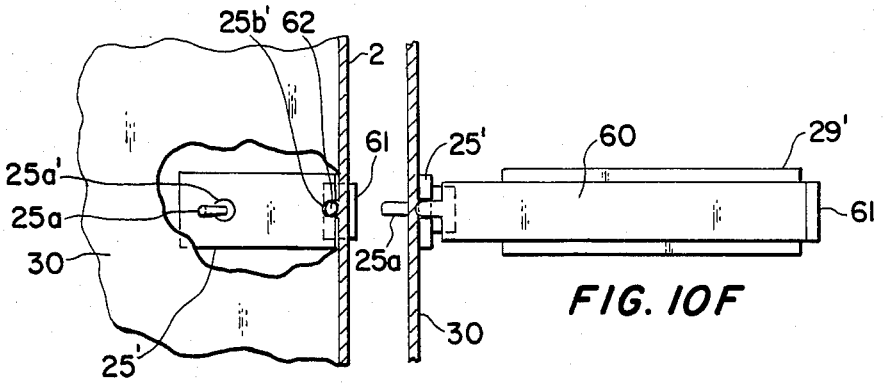
FIG. 10F
FIG. 10C

FIG. 10D
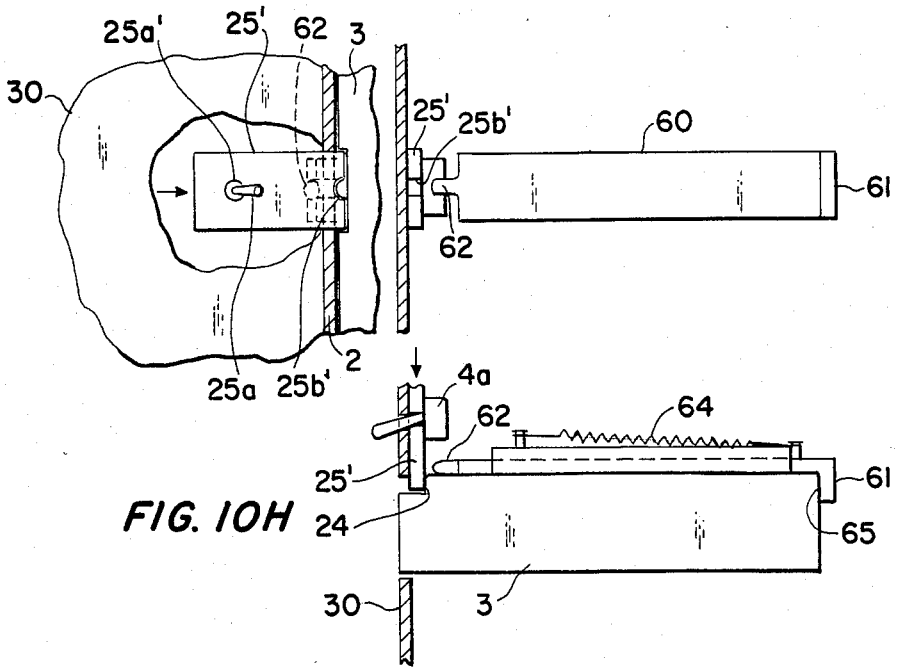
FIG. 10H
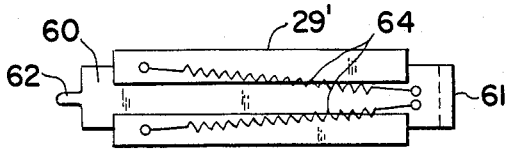
FIG. 10I

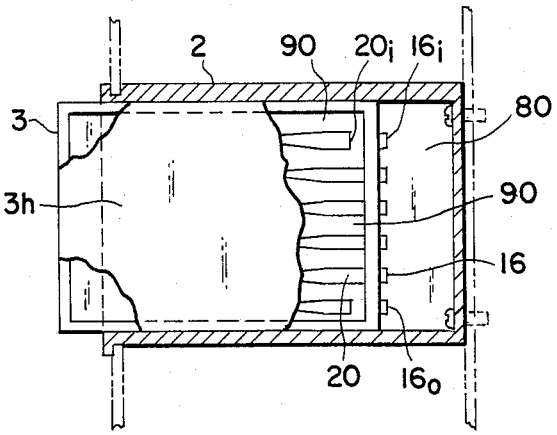
FIG. 15A
FIG. 15B
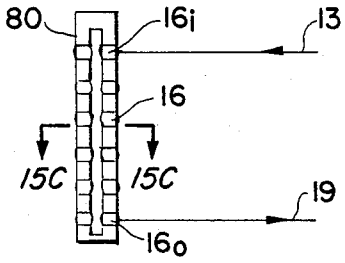
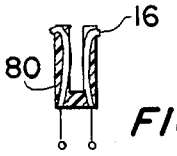
FIG. 15C

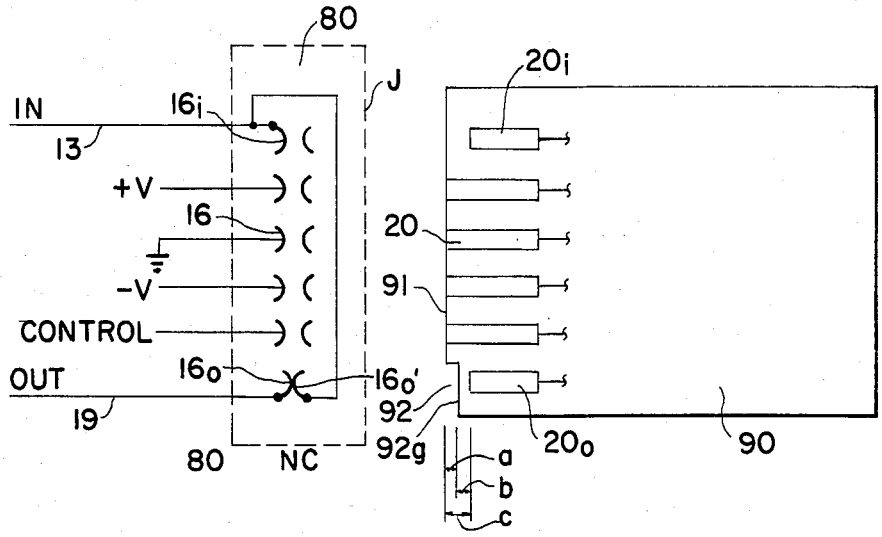
FIG. 18
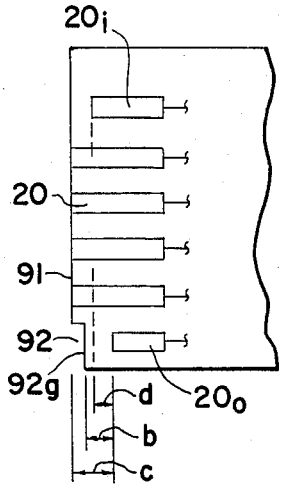
FIG. 19
FIG. 18A
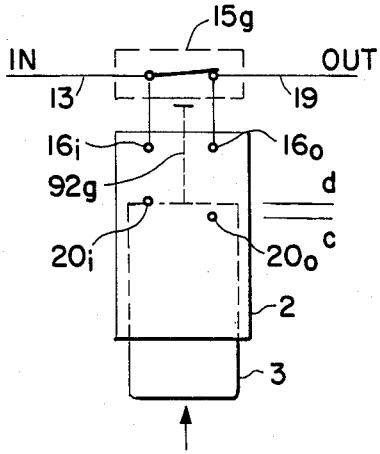

EFFECTS BOX SYSTEM AND METHOD

RELATED APPLICATIONS

The present application is a continuation-in-part of copending U.S. application Ser. No. 479,869 filed Mar. 29, 1983, now abandoned, which is a continuation of copending U.S. application Ser. No. 150,813, filed May 19, 1980, now issued as U.S. Pat. No. 4,388,490; cross reference is also made to copending U.S. application Ser. No. 420,846 filed Sept. 21, 1982, now U.S. Pat. No. 4,481,661, and copending U.S. application Ser. No. 503,842 filed June 13, 1983, now U.S. Pat. No. 4,479,238.

BACKGROUND OF INVENTION

Music and/or audio signal processing circuitry has become important in the field of audio electronics in connection with the electronic modification of electrically amplified musical audio signals or the production thereof. A wide variety of circuit designs have been developed and are constantly being developed to deliver new and interesting sounds in live performances, recorded performances, or the modification of recorded performances.

These circuits are considered componential and appear on the market, quite often, in modular form, self-contained and equipped to be linked to an audio system. In numbers, these become difficult to handle and once linked to a system, the changing of their sequence becomes a spaghetti-like affair, in that cords or cables, must be reckoned with. And a musician using these, in numbers, is, during a live performance, usually confined to the sequencing originally established. Flexibility is at a minimum.

Some systems have a feasible number of these incorporated in them, and, in some cases, a switching arrangement allows complete sequencing flexibility; but in larger numbers, this becomes less and less feasible. Thus, many operators of these systems add to their system a desired number of the above described modular components, and this operation becomes a combination of the two.

The device and method for which a patent is herein applied is based upon neither of the above with respect to sequencing or changing of components, i.e., effects.

The use of these circuits, i.e., effects, would be enhanced if such circuits could be easily changed and resequenced, particularly during a performance, preferably without disturbing the continuity of the audio signal being delivered in the performance, or introducing spurious signals into the performance, and if such a system could be compacted to a relatively small size and weight, be of a relatively low cost, and allow the consumer the use of a wider number and variety of circuits than is generally feasible in a large system.

SUMMARY OF THE INVENTION

A method and system of changing, or substituting one for another, and of organizing, arranging and rearranging the sequential order of component circuits having particular sound effect functions, housed as modular components in the form of circuit-bearing cartridges or audio effects circuit modules, in any electronic audio system so predisposed, in a manner that, in effect, provides for noiseless (i.e., non-generation of spurious signals into main signal path), uninterrupted main signal path flow through said system, during performance, i.e., during operation of said system.

Said method is incorporated in an audio signal processing unit or system commonly known in the vernacular as an effects box. The arrangement for processing audio signals includes a main housing containing a main circuit apparatus, and having module-receiving recesses. Modules, containing any of a wide variety of componential signal processing circuits well known in the art and each having at least one input and one output, can be received in said recesses, so that each module can control the incoming audio signal in a unique way to provide a different sound output. A multiple of mother module controls, i.e., external controls of the module circuit, consisting of switches and potentiometers, are positioned on the main housing immediately adjacent to and surrounding, at least partially, said recess. Each module has markings identifying its circuitry function and indicating which controls on the main housing control module operation. The module has multiple contact elements positioned to contact corresponding main circuit contact elements connected to main circuit and positioned on the front side of the far end of said recess and mounted on an elastomeric sheet, i.e., a foam slab mounted thereon. Initial contact is made at a predetermined depth of insertion of the module, and full contact is made just before full insertion and then held upon the seating, or locking, of said module in said recess. A mechanism, i.e., a switch-coupled latch is positioned on said main housing as a means, in part, for the expulsion or partial ejection of the module from the recess, in reverse of said locking via said mechanism.

In order to avoid the generation of spurious signals into said main signal path during the changing of a module, and in order to maintain the integrity, i.e., the uninterrupted flow, of the main signal path through the system, even while a recess is partially or fully devoid of a module, a combination of electro-mechanical mechanisms, such as a switch-coupled latch, two switches, and foam slab provides that during all stages of operating and operation, said main signal is noiselessly routed with respect to a recess either: (a) into and out of said recess and its locked-in module; (b) connected as a "bypass" of said recess; (c) connected to "pass-it-by" as described hereinafter.

Included in said main circuit apparatus and said main housing are the following conventional things: input and output jacks and their respective attenuators (potentiometers); one buffer-amplifier (at the input jack); a conventional, conventionally sophisticated a.c. to d.c. power supply, and other conventional necessities and accessories.

The module can be shaped in the form of an unopened deck of playing cards, of light-weight break-resistant type plastic, devoid of protuberances, devoid of its own necessary external controls, and as such, be of minimal costs, compactly storable and portable, as opposed to conventional effects, whose housings are normally of heavy gage metal, contains its own power supply, its own external controls, its own input and output jacks, and once linked to a system, cannot be relinked in a different sequential order with the ease and facility provided by the invention herein, especially during a live musical, or otherwise, performance.

The novel features of the invention are set forth with particularity in the appended claims. The invention will be best understood from the following when read in conjunction with the accompanying drawings.

The field of audio electronics has long evidenced devices for noiselessly switching or routing the live audio path of a system while maintaining the continuity of the audio path. Although the present invention, as disclosed in the basic and improved embodiments herein, utilizes such noiseless audio switching devices to accomplish predetermined but timely executed switching or routing of the live main audio path of the audio signal processing system, there is nothing in the prior art for noiselessly inserting and removing an audio effects circuit module into and from the live main audio path of an audio signal processing system while maintaining the continuity of the live main audio path thereof, whether in this, the facile and rapid manner of the invention, or any other manner.

A fact of life for many performing musicians is the untimely failing of batteries, the prime source of DC power for many of the floor-placed audio effects circuit modules manufactured today. Such untimely failings cause an audible deterioration, if not a disappearance, of the audio signal emanating from the musician's instrument, and thus an interruption of the performance. These, in the vernacular, "floor-boxes" usually contain bypass foot-switches, and placing the foot-switch of the failing module in a bypass position usually restores the continuity, at least, of the audio signal. However, with several, as is often the case, of these modules linked into the audio path of the amplification system, locating the failing module while performing isn't always easy, and is, at best, diversionary for the musician. While it is conceivable that a manufacturer might decide, for whatever reason, to similarly include the need of or placement of such a battery in a cartridge, a cartridge, that is, containing an audio effects circuit such as described herein, the invention herein, while not preclusive of such a concept, neither illustrates nor projects such a concept.

Yet, it is the inadherence to that concept, the preconception of having the cartridge-contained audio effects circuit receive its DC power from and by means provided in the main housing that poses, of itself, particular problems associated with the noise producing characteristics natural to the abrupt connecting or disconnecting of DC power to or from a component audio circuit of an otherwise live audio system.

To date, prior art offers no device for the stopping of the natural electrical phenomena of the arcing or sparking, which causes the generation of spurious signals into the audio path of a system, that arises from the abrupt application or removal of DC power by the abrupt making or breaking of DC power connections by a switch or contact elements or the like in the DC power lines of a component audio circuit, such as an audio effects circuit, operatively incorporated in or linked into the live audio path of a system. However, the invention herein provides a way of avoiding such unwanted or undesired spurious signal phenomena during insertion and removal of an audio effects circuit into and from a live main audio path. It does this by keeping the live audio path electronically remote from the recess and thusly from the audio effects circuit during insertion and removal, that is, during any such noise producing making or breaking of contact between the respective corresponding recess and module DC contact elements, by connecting and disconnecting the audio path to and from the audio effects circuit at predetermined but timely executed times in a manner that provides for maintaining the continuity of the audio path while permitting rapid and noiseless changing of the audio effects circuit modules as heretofore unknown in the prior art.

Further simplified and improved embodiments of the present invention are set forth hereinafter which incorporate an audio signal processing system having means for permitting noiseless insertion and removal of audio effects circuit modules housed as cartridges into and out of a live audio path during operation of the system without introducing spurious signals, and having means for maintaining the continuity and uninterrupted flow of the audio signal path through the system.

In some embodiments, at least one bypass switch can be utilized by an operator in lieu of the combination of the two switches of the basic embodiment to provide a more simplified system which still realizes significant benefits of the present invention, namely, a system and switching arrangement allowing for noiseless and uninterrupted substituting, organizing, arranging and rearranging the sequential order of the audio effect circuit modules to provide different sound outputs. The bypass switch has two states or modes, i.e., an operative mode for routing the audio signal path to and from a recess via and through a module installed therein, and a bypass mode for routing the audio signal by the recess. The bypass switch may comprise a double pole double throw or single pole double throw switch, preferably being in the form of either a panel mounted switch or a foot switch. In one embodiment, a bypass switch is carried in the cartridge. Bypass switches can be connected with each recess individually and a system bypass switch for bypassing a plurality of recesses all at once can be provided also.

The corresponding contact elements in the various embodiments may comprise conventional connectors, some of which may function also for retaining the cartridge in the recess. Such conventional connectors include, for example, cinch connectors, pin and plug connectors, printed circuit board edge connectors, and the like as manufactured by nationally known firms such as AMP of Hamsburg, Pa., TRW of Elk Grove, Ill., and Vector of Sylmar, Calif. According to predesign, such connectors can be used in multiple purpose fashion to simultaneously serve the purposes of contact element, switch, and retaining means with respect to the module and its circuit. On the other hand, when utilizing spring loaded point to point type contacts, such as those disclosed in the basic embodiment, or those manufactured for example by Everett/Charles, Inc. of Pomona, Calif., the separate cartridge retaining latch mechanism may be incorporated such as described more fully hereinafter. In any case, it is intended that the term "contact element" as used herein be interpreted in the claims as inclusive of, but not limited to, use of such conventional connectors.

The operation of the simplified embodiments can be enhanced according to the present invention by adding a switch for maintaining continuity by routing the audio signal past a recess when a recess does not have a module or cartridge module installed therein such as a single pole single throw switch. The switch may comprise an electronic or mechanical switch, e.g. the push-button switch as shown in the basic embodiment, or other suitable mechanism.

In another embodiment, insertion into the audio path is completed by connecting the audio signal path to the audio effects circuit via the recess audio contact elements only after the contact elements for carrying the DC power and controls of the audio effects circuit have been solidly connected so that the generation of spurious signals is avoided. An edge connector, and a printed circuit board carrying the audio effects circuitry and components may be utilized. The audio signal input and output contact elements are mounted on the board are set back a predetermined distance from the edge of the board, to make operative contact with the corresponding recess contact elements after solid electronic contact has been established and stabilized between all other contact elements to avoid generation of spurious signals into the main audio signal path. A mechanism for maintaining continuity while the recess is empty is also provided. Other embodiments include a notch in the board so that a normally closed switch formed by contact elements of the edge connector is opened only after solid electronic contact between all other corresponding and contact elements is established, but prior to electronic contact between the corresponding audio signal contact elements. One or both of the audio signal input and output contact elements of the board may be set back a predetermined distance from the leading edge of the board notch, preferably a distance short enough such that the distance between the leading edge portion of the notch which opens the normally closed switch, and the forward-most portion of the contact elements which operatively contact or engage the corresponding recess contact elements is substantially small so that there is substantially no humanly perceptible interruption in the sound output.

When the switch and contact elements are physically constructed as integral components wherein the contact elements serve the further purpose of providing a switch, and vice versa, as in the edge connector embodiments, it is recognized that contact completion and signal flow occur simultaneously. Therefore, to permit noiseless changing of effects in such integral embodiments, the sequence of the mating and unmating of corresponding contact elements should be such that the audio path switching is actuated last upon insertion, and first upon removal.

In other embodiments herein, such as the basic embodiment, the switches and contact elements are separate components and physically apart performing functions unto themselves. In these embodiments, the functions are performed without need of or regard to a particular mating sequence or lack thereof, or simultaneity or lack thereof, with respect to the individual or collective makings or breakings of electronic contact between the corresponding contact elements.

The novel concept of noiselessly inserting and removing different audio effects circuits into and from the live main audio path of an audio signal processing system while maintaining the continuity of the main audio path permits the facile and rapid attainment of many different sound effects. Successfully implementing this concept presents a number of problems which are overcome by the present invention. The main problems are primarily concerned with the generation of spurious noise signals and interruption of the live main audio signal. The present invention handles such noiseless audio switching devices to accomplish noiseless insertion and removal of audio effects circuits by the predetermined but timely switching or routing of the audio path. The present invention handles these problems and realizes this concept by providing at least one recess adapted to operatively and removeably receive a cartridge containing the audio effects circuit, the cartridge and recess each having correspondingly engageable contact elements, and predetermined and timely routing of the live main audio signal. The predetermined routing of the live main audio signal is either to bypass the recess, or to flow to and from the recess via and through an installed cartridge. Timely executed switching of this routing permits noiseless insertion and removal of the cartridge and its audio effects circuit into and from the recess and the live audio signal path while maintaining continuity.

Specifically, with respect to insertion of a cartridge into the recess and the live audio signal path, corresponding electronic contact between all noise producing contact elements should be established before the live audio signal is directed to flow to and from the recess via and through the fully installed cartridge. With respect to removal of the cartridge from the recess and the live audio signal path, the audio signal path should be directed to bypass the recess before there is any disturbance, resulting from the removal, to the fully installed condition of the noise producing contact elements. The present invention permits the noiseless insertion and removal of the audio effects circuit into and from the live main audio path to be easily accomplished in an extraordinarily short time frame, being orders of magnitude less than anything heretofore disclosed in the prior art.

Moreover, with it being well known in the art that every unique serial ordered sequence of a given group of audio effects circuit modules provides a different final sound output, and that rearranging, substituting and merely introducing effects into a live audio path by the linking of conventional modular effects into an audio system by patch cords or the like is time consuming and inconvenient, and that the same is equally true with respect to the unlinking of such conventional modular effects from existing audio systems, then it can readily be seen that the invention provides compactness, portability, minimal manufacturing cost of the individual cartridges, ease of individual changeability, and, of collective changeability of their sequential order to arrive at a large number of permutations of unique combination sound effects in an unusually short time period in an order of magnitude heretofore unheard of, while the system is in operation, without generating spurious signals into the live audio signal path, while at all times maintaining the continuity of the audio signal path.

FIGS. *7a–7i* are a multi-view of a latch-coupled switch assembly showing lock-in of a module.

Figures 8, 9:
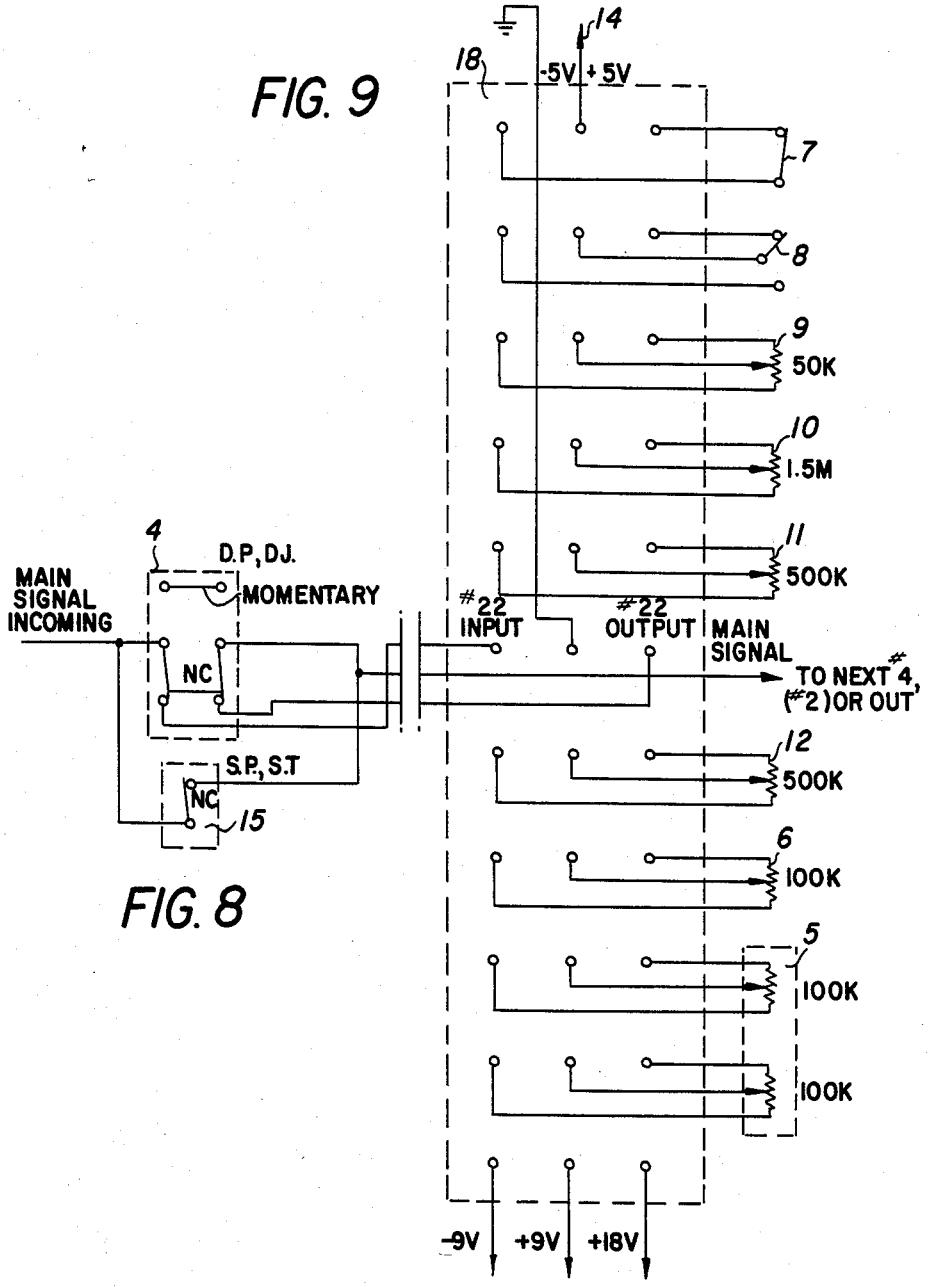

FIG. 8 is a sectional schematic of conjunctively working switches.

FIG. 9 is sectional view of junction panel of a recess indicating various branches of circuitry connection to recess and thus to installed module.

Figure 10:
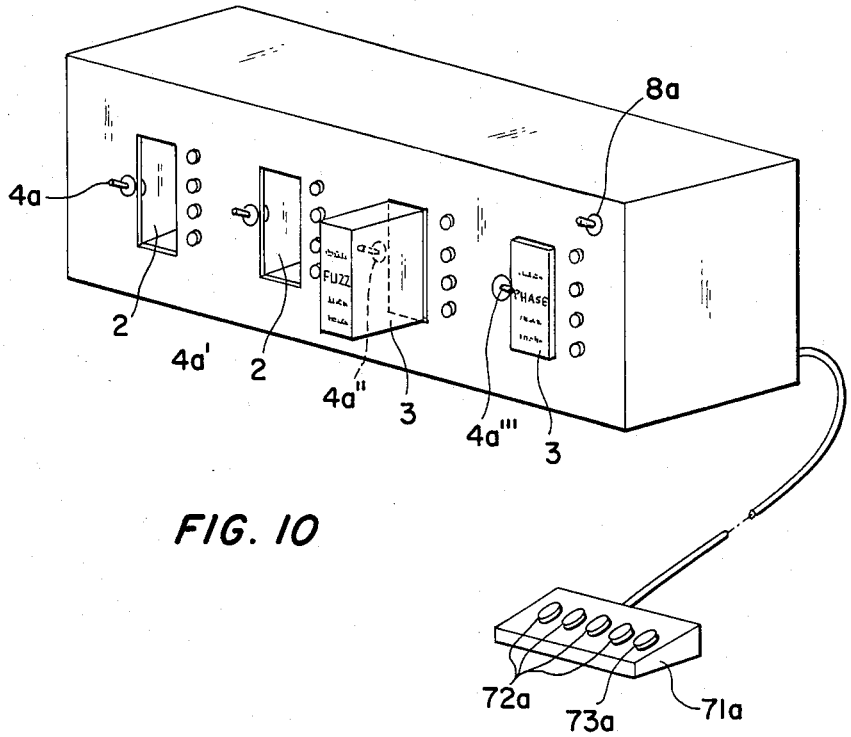

FIG. 10 is a perspective view of an alternate embodiment of an audio signal processing system constructed according to the present invention.

Figure 10A:
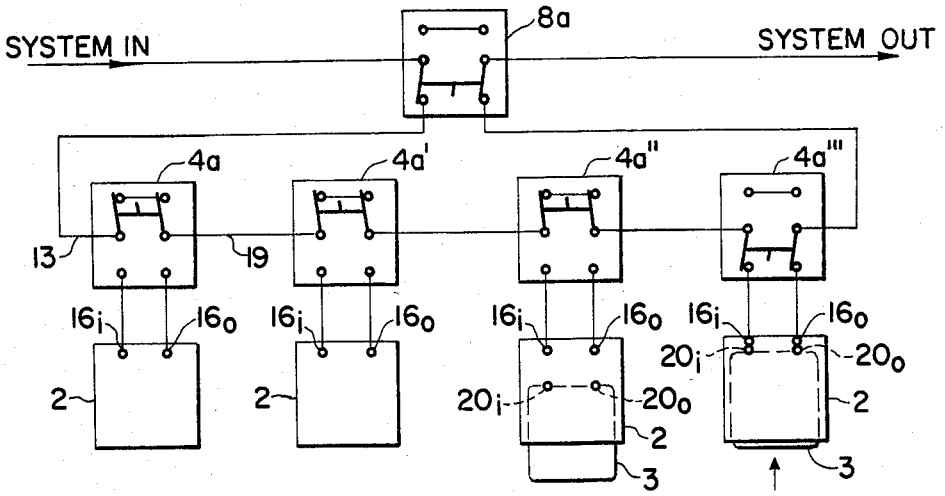
Figure 10B:
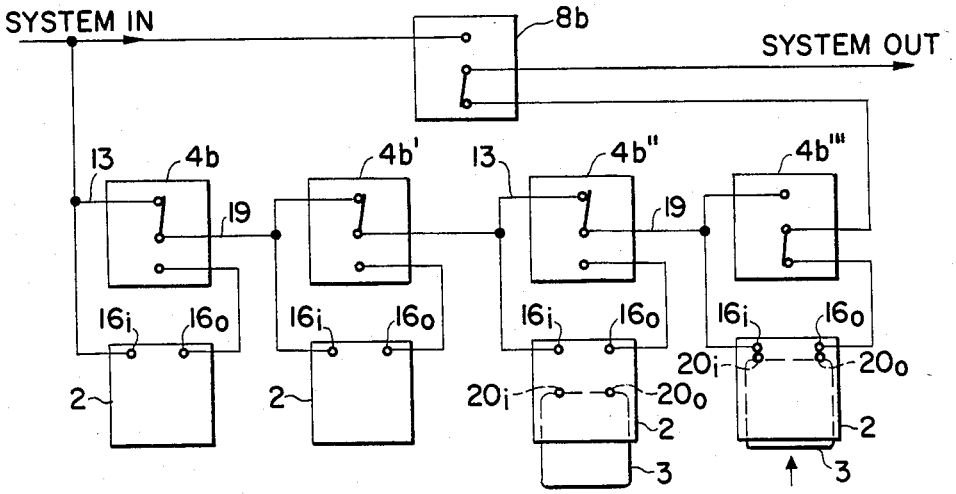

FIGS. 10A–10B are each an electrical block diagram of one embodiment of the present invention utilizing double pole double throw and single pole double throw bypass switches, respectively.

FIGS. 10C–10J are multiviews of an automatic bypass locking mechanism for use in the present invention.

Figure 11A:
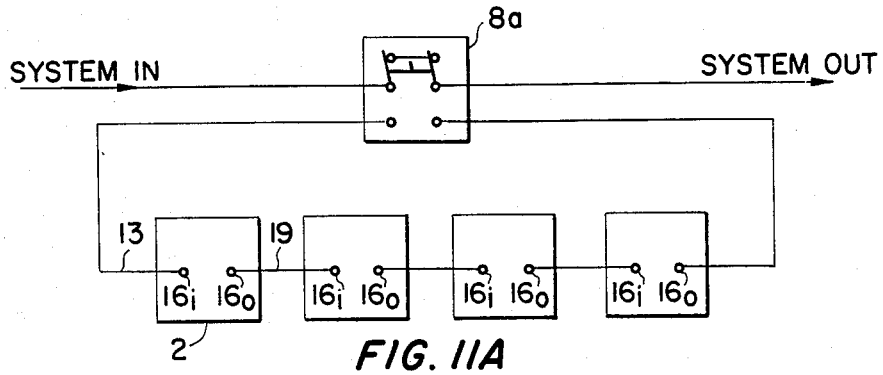
Figure 11B:
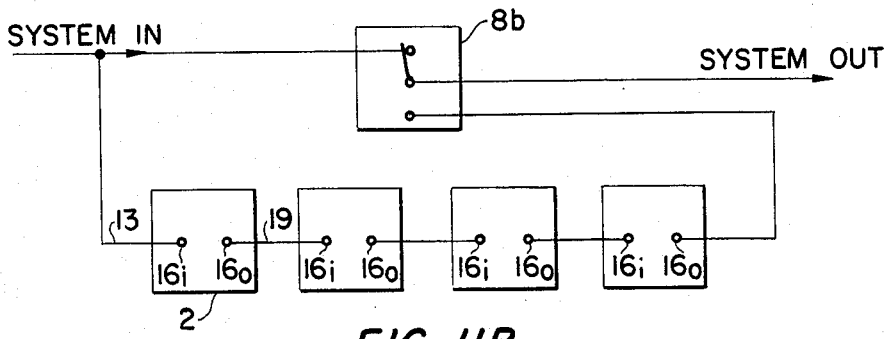

FIGS. 11A–11B are each an electrical block diagram, of an alternative embodiment of the present invention utilizing double pole double throw and single pole double throw system bypass switches, respectively.

Figure 12A:
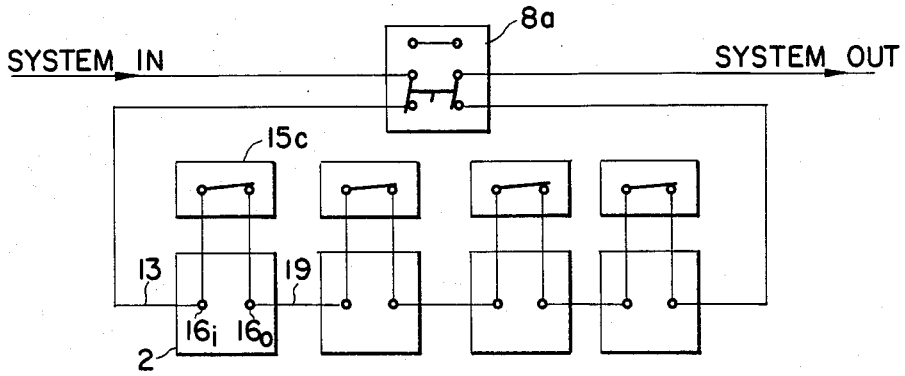
Figure 12B:
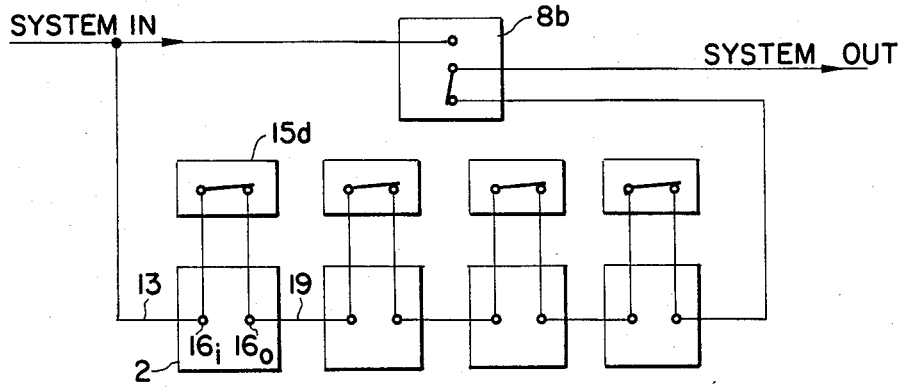

FIGS. 12A and 12B are each an electrical block diagram of the system utilizing double pole double throw and single pole double throw system bypass switches, respectively, in conjunction with single pole single throw switches.

Figure 13A:
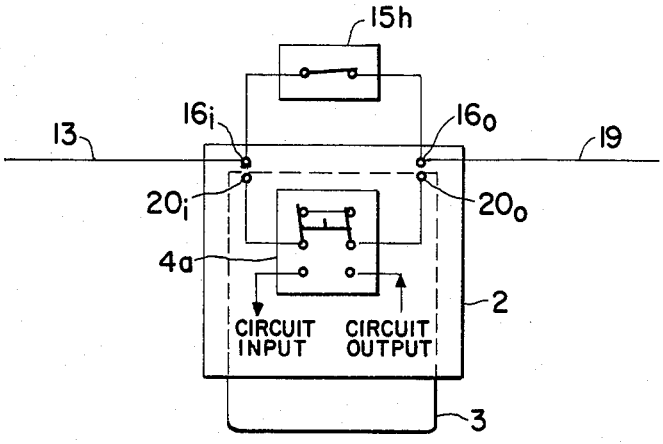
Figure 13B:
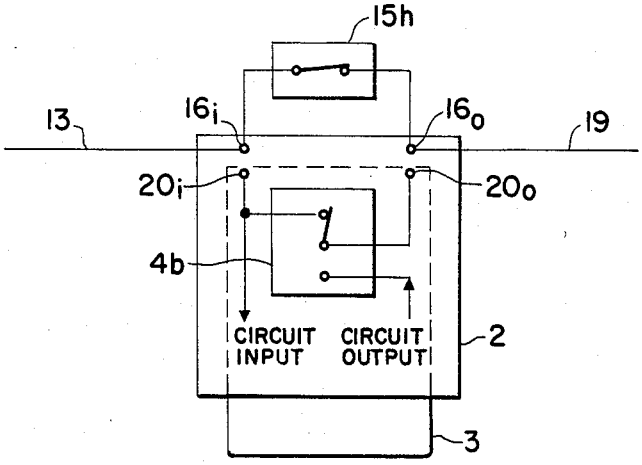
Figure 13C:
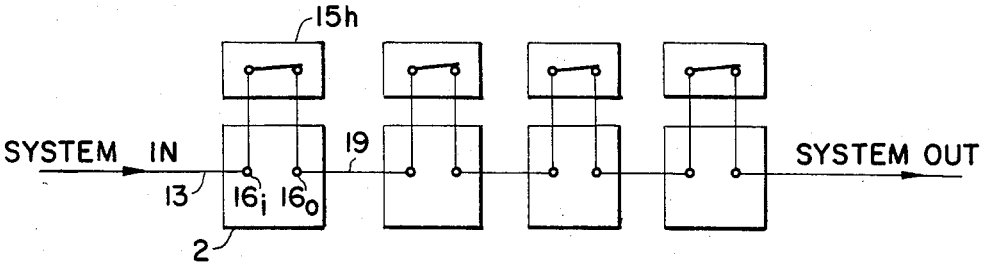

FIGS. 13A–13C are electrical block diagrams utilizing a single pole single throw switch in conjunction with double pole double throw and single pole double throw cartridge bypass switches, respectively.

Figure 14A:
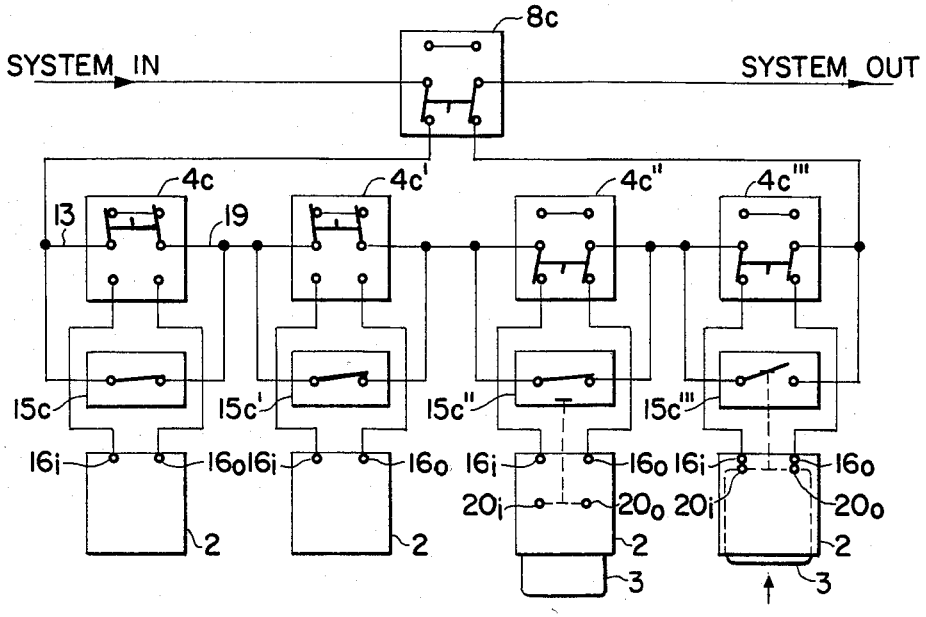
Figure 14B:
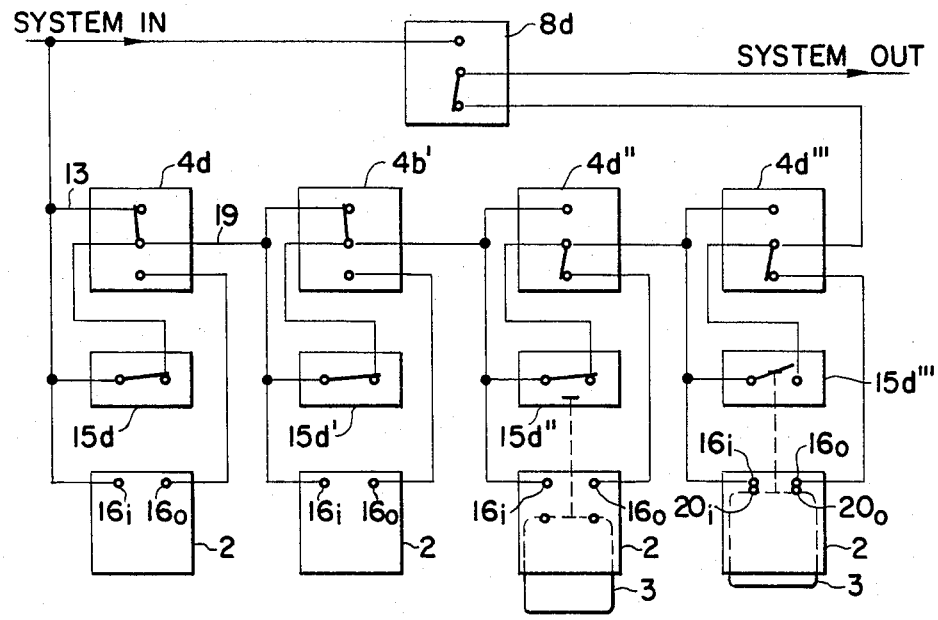

FIGS. 14A–14B are each an electrical block diagram of one embodiment of the present invention utilizing single pole single throw switch in conjunction with double pole double throw and single pole double throw switches, respectively.

FIGS. 15A–15C are multi-views of a partially inserted module and recess in accordance with the present invention, including a side elevation view, partly in section, of a partially inserted module, a top plan view of an edge connector, and a section view taken along line A—A of FIG. 15B, respectively.

Figure 16:
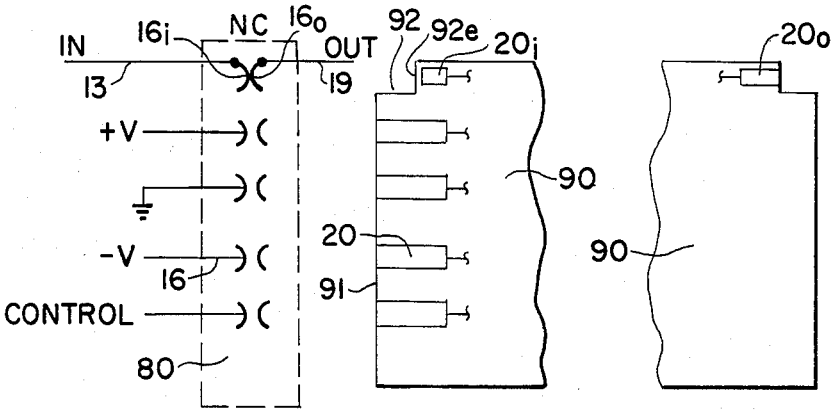
Figure 16A:
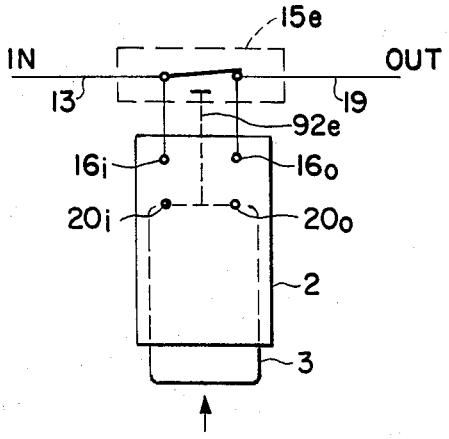

FIGS. 16–16A are diagrammatic representations of an alternative embodiment of the present invention showing an edge connector having a normally closed switch incorporated therein.

Figure 17:
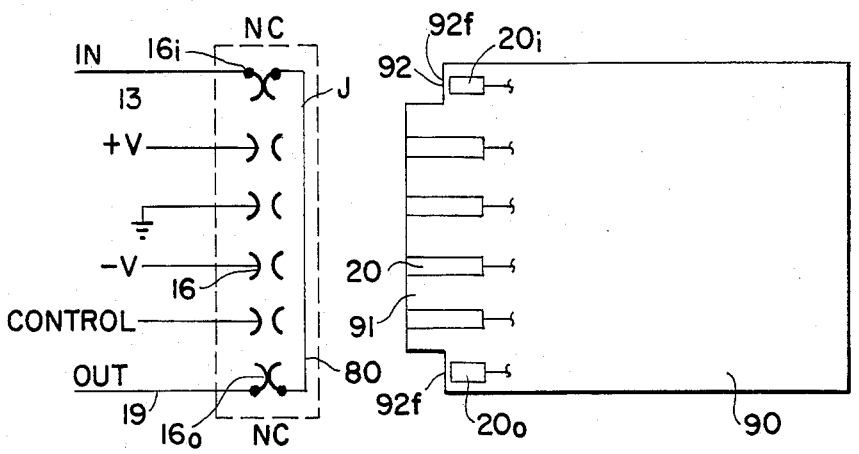
Figure 17A:
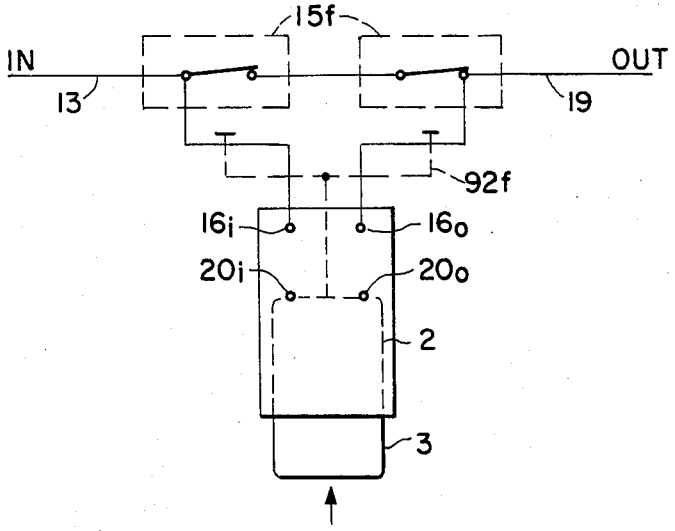

FIGS. 17 and 17A are diagrammatic representations of an alternative embodiments of the present invention showing an edge connector having two independent normally closed switches incorporated therein.

FIGS. 18 and 18A are diagrammatic representation of one embodiment of a switching means showing an edge connector having a normally closed switch incorporated therein.

FIG. 19 is a top plan view of a portion of a circuit board for use in accordance with the present invention.

Figure 20:
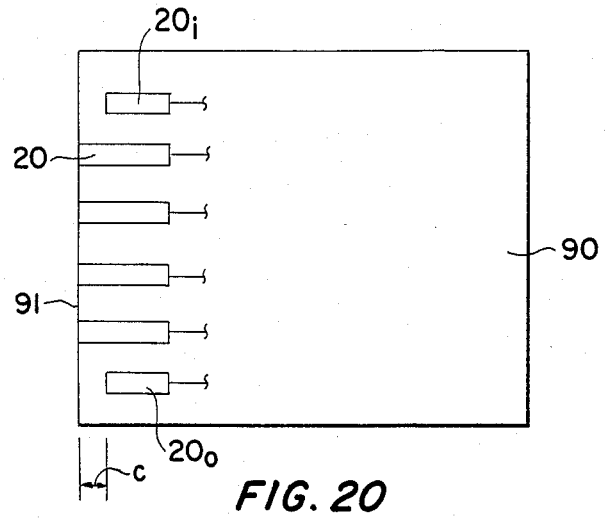

FIG. 20 is a top plan view of a portion of a circuit board for use in accordance with the present invention.

Figure 21:
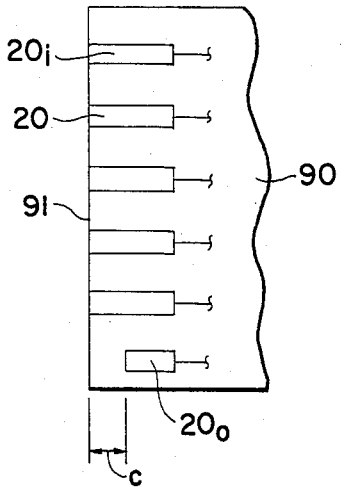

FIG. 21 is a top plan view of a portion of a circuit board for use in accordance with the present invention.

Figure 22:
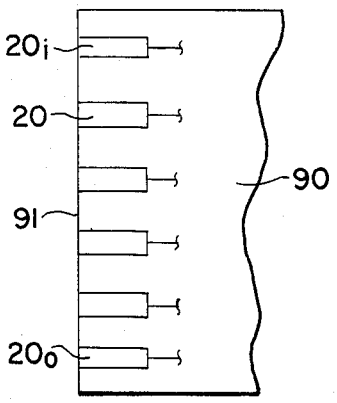

FIG. 22 is a top plan view of a circuit board for use in accordance with the present invention.

Figure 23A:
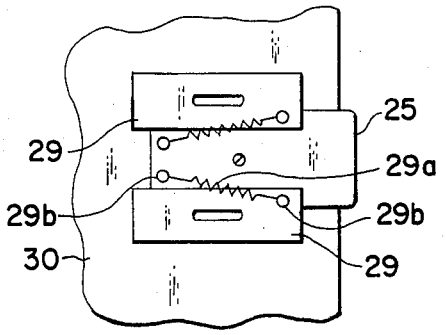
Figure 23B:
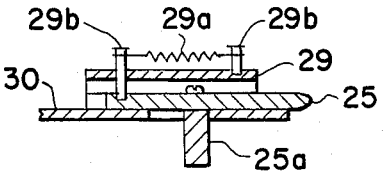

FIGS. 23A and 23B are a bottom and sectioned side view, respectively, of one embodiment of a retaining means in accordance with the present invention.

DETAILED DESCRIPTION OF THE PREFERRED EMBODIMENTS

Figure 1:
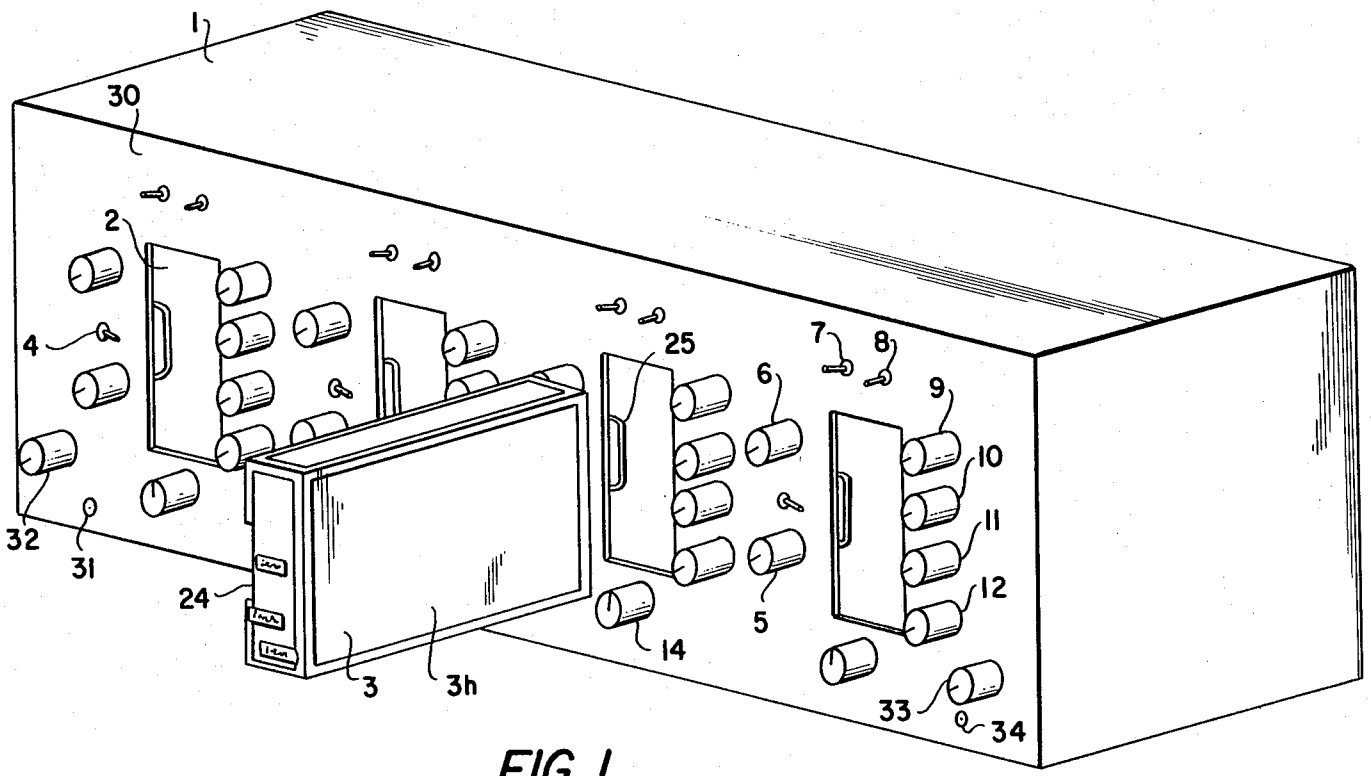
FIG. 1 is a perspective and partially exploded view of an audio signal processing system ("effects box") constructed in accordance with the present invention.

FIG. 1 illustrates a view of an audio signal processing unit or system, "effects box", which includes a main circuit apparatus having a main incoming audio signal input source terminal (not shown), a main housing 1 having module-receiving recesses 2 designed to receive one or more module(s) 3. Said modules are, of course, reciprocally designed to fit into said module-receiving recesses.

Each module 3 can contain in its module housing 3h, any of a wide variety of audio signal processing circuits, commonly called "effects", which can perform a particular function on the incoming audio signal or the main signal path of said main circuit in a unique way to provide a different sound output, as are well known in the art.

Figure 5:
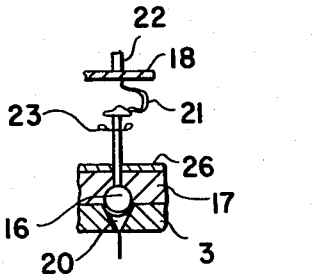
FIG. 5 is a partial sectional view of a portion of the apparatus of FIG. 4, in a fully inserted position.
Figure 4:
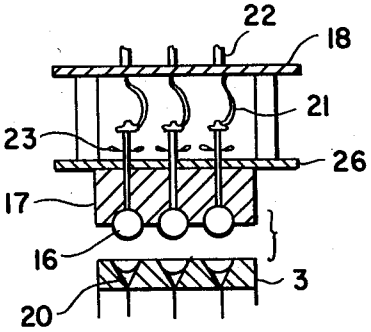
FIG. 4 is a partially sectional view of the apparatus of FIG. 3, with the module in a partially inserted position.
Figure 3:
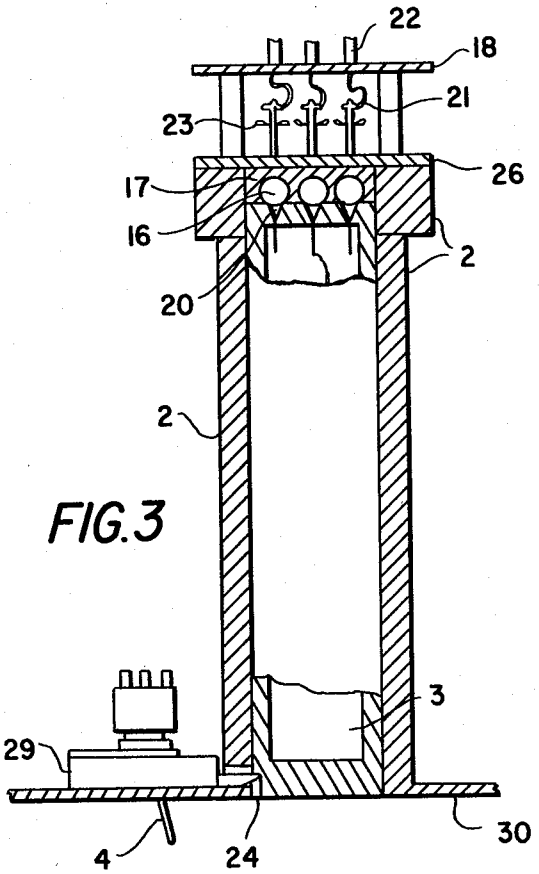
FIG. 3 is a partial sectional view of the apparatus of FIG. 2, shown with the module in fully inserted position.
Figure 6B:
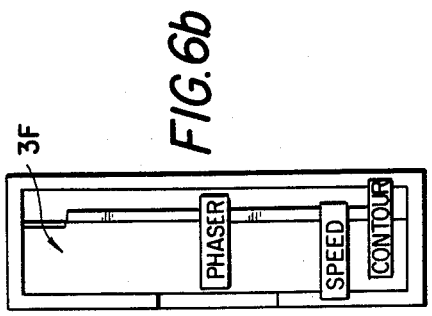
FIGS. 6A–6E are perspective views of a module assembly.
Figure 6E:
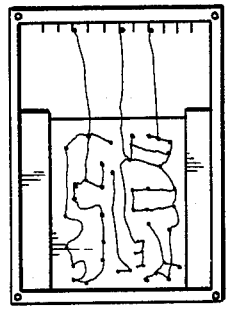
Figure 6A:
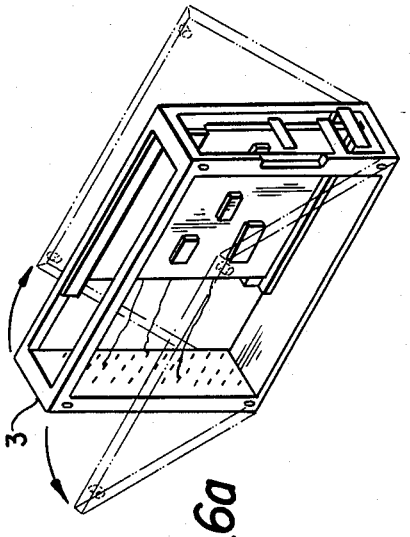
Figure 6D:
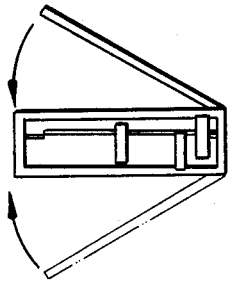
Figure 6C:
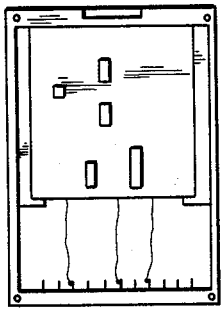
Figure 7B:
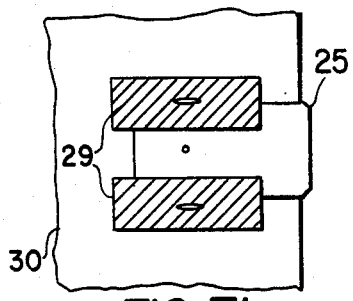
Figure 7F:
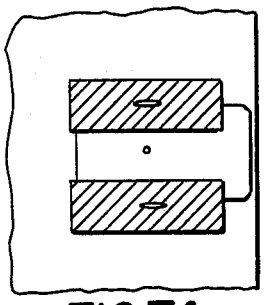
Figure 7A:
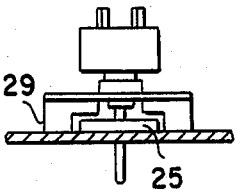
Figure 7C:
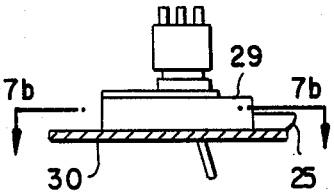
Figure 7G:
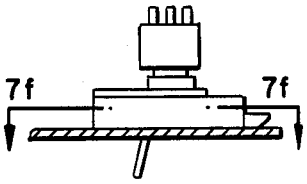
Figure 7D:
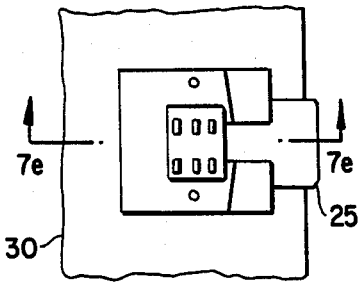
Figure 7H:
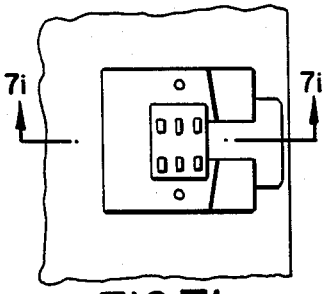
Figure 7E:
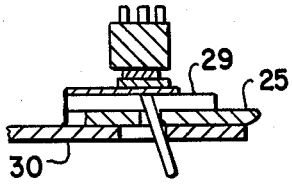
Figure 7I:
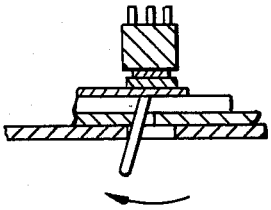

The module housing 3h has embedded in it a multiple of module contact elements 20, as shown in FIGS. 3, 4, and 5 positioned to contact recess contact elements 16, as shown in FIGS. 3, 4, and 5 upon installation of module 3 into recess 2.

A group of potentiometers and switches 5, 6, 7, 8, 9, 10, 11, 12, called mother module controls are positioned on main housing 1 immediately adjacent to recess 2, and have all of their respective terminals connected only to their respective preassigned recess contact elements 16, an identical group surrounding each recess and so positioned and connected so that said group of controls are not a part of and have no effect upon the said main circuit or system until and as of when a module 3 is fully installed in the recess 2. While a module 3 is so fully installed, said group of controls serve as the external controls of module 3, to control the operation of its circuit as is well known in the art.

Markings on the face end 3f of each of module 3 (see FIGS. 6A–6E) identify its particular function performed by its particular effect circuit, and indicate which of said controls control the module's operation. When fully installed in a recess, said face end 3f of module is flush with the control panel 30 of said main housing 1 and said markings contain arrows pointing to the controls on said control panel 30 to be used with respect to the module's circuit and their respective control functions.

FIGS. 2, 3, 4, 5, illustrate the manner in which recess contact elements 16 are mounted and positioned and make contact with module contact elements 20. An elastomeric member, such as a foam slab 17, is positioned on the front side of the far wall 26 of recess 2. As can be seen in greater detail in FIGS. 4, 5, recess contact elements 16 are positioned and embedded, somewhat, in foam slab 17, so that their pins project through foam slab 17 and through their respective guide holes in far recess wall 26, retained there by retainers 23, connected via thin flexible, insulated wires 21 to junction pins 22 which are molded into and project through recess terminal junction panel 18. It is at this panel 18 that said main circuit and said controls 5 through 12 are connected to appropriate recess contact elements 16. In this manner recess contact elements 16 have individual compressive sliding action through said guide holes.

FIG. 4 further shows the state of recess contact elements 16 before corresponding contact is made with module contact elements 20. FIGS. 5 and 3 show the state of recess contact elements 16 in their compressed full contact with module contact elements 20 when module 3 is in a fully installed position.

This unit, or system, or "effects box" provides demonstrably a practical application and use and one objective of said unit is to provide a versatile means for modifying an audio signal from an external audio signal source via said audio effects circuit modules 3 and delivering the modified signal to an audio system.

The main signal path flow of said audio signal or routing through said unit is a basic series circuit, taking said main signal into and out of a recess 2 and its audio effects circuit module 3, then into and out of the next recess 2 and its audio effects circuit module 3, and so on, in series, except for the following.

When a said recess 2 is devoid of a module 3, then said recess 2, with respect to said main signal, is in a "bypass" state. When a module 3 is in said recess 2 in any position other than said fully installed of fully inserted, locked-in position, said recess 2, again with respect to said main signal, is then in a "pass-it-by" state wherein the recess contact elements are electronically disconnected from said main audio signal path.

A fuller outline of said basic series circuit routing of how said main signal path is connected is as follows:

Said external audio signal source is accepted at input jack 31, to an input attentuator potentiometer 32, to input of a conventional buffer-amplifier as part of said main circuit apparatus not shown, and output of said buffer-amplifier to first said recess 2, or "passes" by it, and so on as previously described to output attentuator potentiometer 33, to output jack 34, delivering said modified signal, or unmodified signal if each of said recesses 2 is devoid of or contains, as previously described, a partially installed module 3, to a said so receptive audio system.

FIGS. *7a–7i* illustrate an assembly which provides, among other things to be described herein, the means for the locking-in of a fully installed or fully inserted module 3 in a recess 2, and for the unlocking, freeing, of module 3 from recess 2.

Figure 2:
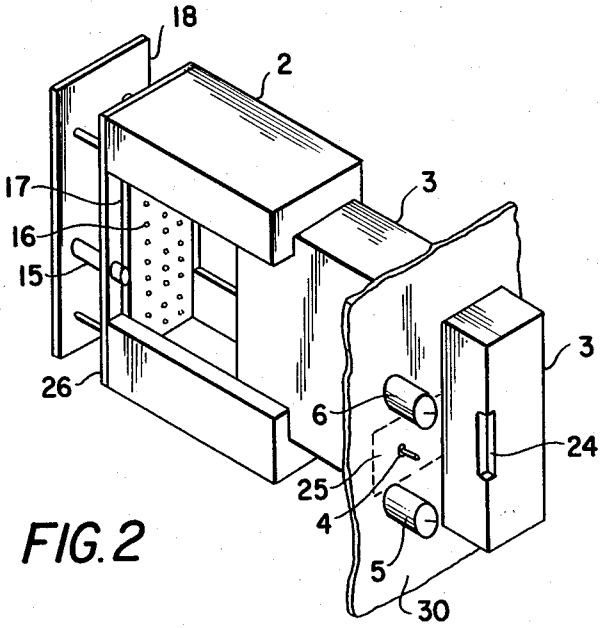
FIG. 2 is a partial perspective view of the system of FIG. 1, showing a module thereof in a partially inserted position.

FIGS. 1, 2, 3, show the position of said assembly on control panel 30 of main housing 1.

As can be seen, latch 25 is coupled to the handle of momentary toggle switch 4 and is held slidably captive by u-bracket 29 against the inner surface of control panel 30. Switch 4 is attached to u-bracket 29 so that handle of switch 4 projects through the coupling hole of latch 25 and through control panel 30 making said handle accessible to manual finger tip manipulation or displacement of it. In their simultaneous normal positions, said handle of switch 4 rests laterally against side of hole in control panel 30, and the quarterrounded end of latch 25 projects slightly into recess 2. FIGS. *7a–7i* further shows the simultaneous displaced or momentary positions of switch 4 and latch 25 via arced arrow and the markings, respectively *4a* and *25a*.

Therefore, noting again the position of said quarterrounded end of latch 25 projecting slightly into recess 2 area its normal, at rest, position can be explained hereinafter.

A slight insertion of a module 3 into a recess 2 displaces, brings to their momentary positions, latch 25 and, simultaneously, handle of switch 4. When module 3 reached its fully inserted and fully installed position in recess 2, said latch 25, under the inner spring force of switch 4, via said handle of switch 4, springs back to its normal position, into locking-notch 24 of module 3 as shown in FIGS. 1, 2, 3, and 6 thereby locking and holding said module 3 in said fully installed position in recess 2.

A slight left lateral manual or fingertip manipulation of said handle of switch 4 again displaces and brings to their simultaneous momentary positions, said handle of switch 4 and latch 25, allowing said module 3 to be partially expelled or ejected to an inch or so of ejection, allowing free and complete removal of module 3 from recess 2; whereupon, said handle of switch 4 and latch 25 simultaneously spring back to their normal, at rest, positions.

FIG. 2 illustrates the position of a momentary push-button switch 15, on recess wall 26, abutting said foam slab 17.

The present invention permits one to change and/or arrange and rearrange the sequential or serial order of modules in said "effects box", in a manner so that the only effect upon the main signal path flow through the system by and during all stages of the insertion and removal of a module is the quiet appearance of the intended "effect" of the module's componential circuit, or, respectively upon removal of module, quiet disappearance.

FIGS. 8 and 9 illustrate, in a sectional schematic, the flow of said main signal path with respect to a recess 2, i.e., its passing around, and its entrance to and exit from said recess 2 and its module 3 via #22 input and #22 output terminals per the conjunctive working of switch 4 and switch 15.

Switch 4 is a double pole, double throw, momentary toggle switch whose normal position is closed. Switch 15 is a single pole, single throw, momentary push-button switch whose normal position is closed, i.e., on. Connected as schematically indicated, with the centers of switch 4 breaking and being the pivotal connection of said main signal, its momentary poles wired to each other as the "pass-it-by" pivot and its normally closed poles being, respectively, said 'entrance to and exit from' pivot, and with said centers connected, further, to their terminals, respectively, of switch 15.

When a recess 2 is empty, devoid of a module 3, both of said switches 4, 15 are in their respective normal, normally closed, positions, and, as such, switch 15, via switch 4, has recess 2 in a "bypass" not "pass-it-by" state, in the conventional sense of conventional component bypass circuitry, i.e., disconnecting the output or shorting and connecting input to output but leaving both still connected to recess 2 via its input and output contact elements 16.

A slight insertion of a module 3 into a recess 2, displaces latch 25 which simultaneously displaces switch 4 to its momentary position which is now circuited in concert with switch 15, still in its "bypass" state. Upon further insertion, to a predetermined depth of insertion, module 3 engages push-button of switch 15, displacing to its momentary position switch 15, opening its contacts and taking it out of the circuit, which simultaneously allows switch 4 to function in its momentary, "pass-it-by" state. Both, the input and the output legs of the main signal path, though now connected, are each, respectively disconnected from contact elements 16 of recess 2. A slight but fuller insertion of module 3 brings the initial meeting, and the first physical, but not necessarily precisely simultaneous, contact between all respective and corresponding module contact elements 20 and recess contact elements 16. This is a critical point, a point at which spurious signals might be generated into the said main signal path, were it not for the fact that, switch 4 is in its "pass-it-by" state. At a fuller depth of insertion, after solid physical and electronic contact has been made or established between all just said contact elements, said fully inserted position of module 3 is reached, at which point, as earlier described, latch 25 springs into locking notch 24, as simultaneously switch 4, now, too, in its normal, normally closed position, thereby directs and allows said main signal to flow, via #22 input and #22 output, into and out of recess 2 and its locked-in and now operative and/or operating audio effects circuit module 3.

Noting the now fully compressed states of switch 15 and foam slab 17, it can be seen how foam slab 17 maintains the integrity of contact between module and recess contact elements. Foam slab 17 and switch 15 conjunctively stabilize module 3 in its locked-in position in recess 2, via their respective compressive and/or decompressive forces.

The removal of module 3 from recess 2, in the manner earlier described, provides an exact reverse of the sequence of events just described, including the said partial expulsion and/or ejection or module 3 from recess 2, via said compressive and/or decompressive forces.

FIG. 9 further illustrates a sectional schematic sketch of the back or terminal 22 side of junction panel and/or wall 18, indicating the various circuitry branch connections to terminals 22 for controlling the effects circuit which is not shown as it is well known in the art.

Potentiometer 14 of FIGS. 1, 9, positioned on control panel 301 functions as a bias control to those of modules 3 whose circuitry design is such that requires variable bias control.

In order to maximize noiseless switching functions, said switches 4 and 15 can be of the necessary number of poles to be circuited to actuate and accomplish conventional electronic switching, e.g., integrated-circuit switching.

Included in said main circuit apparatus, is a conventional but conventionally sophisticated sectioned and filtered a.c. to d.c. power supply, feeding sectionally and respectively, the various d.c. potentials to all components as required.

A module can be constructed in any feasible size, shape and material, with contact elements of any correspondingly feasible size of shape, and placed on any end, edge or side of its housing to match a correspondingly constructed module-receiving recess. FIGS. 6A–6E illustrate assembly views of module 3, indicating removable sides, placement of the effects circuit board and its circuit, circuit connecting to contact elements, and face markings.

FIG. 1 illustrates, indicates, four module-receiving recesses 2, but a unit such as herein can be constructed containing any feasible number of module-receiving recesses, even if so desired, a number of just one recess and still be a system which is useful and practical.

Thus, the invention provides a method and system which is versatile to permit the use of a wide variety of componential effects circuits in a relatively inexpensive and compact unit, with modules that can be made of an optimal size and shape, conveniently storable and portable, at a minimal cost.

No detailed original componential circuitry has been presented, or intentionally implied, herein. All component effects circuits for performing particular functions are known in the art and may be modified to the extent of adaptation to use said group of controls 5 through 12, with their predetermined set of various variable resistance values, potentiometers, number of poles and throws, and switches to accommodate corresponding modular circuit design modification.

Although particular embodiments of the invention have been described and illustrated herein, it is recognized that modifications and variations may readily occur to those skilled in the art and consequently, it is intended that the claim be interpreted to cover such modifications and equivalents.

Audio effect circuits are well known in the prior art, and a number of them are referred to in U.S. Pat. No. 4,030,397. For purposes of clarity and understanding of the present invention, such precise circuitry need not be illustrated herein. Detailed circuitry of audio effects circuit modules incorporated into an audio signal processing system is disclosed in a number of reference sources, such as the book *Electronic Projects for Musicians* by Craig Anderton, published by Guitar Player Books (1975, 1978, 1980 Editions), which is incorporated herein by this reference.

Referring now to the simplified embodiments of the present invention, as discussed herein, the present invention permits the convenient and easily permitted changing and resequencing of audio effects circuit modules in an audio signal processing system. The simplified embodiments shown and described hereinafter may be utilized to perform essentially the same functions as those disclosed in the basic embodiment utilizing momentary switches 4 and 15, except that such switches need not be momentary if manually controlled at the option of the operator. The present invention, utilizing audio effects circuit modules housed in cartridges insertable into and removable from a system having cartridge receiving recesses during operation of the system, has always recognized that sound modification of the audio signal be accomplished noiselessly and without interruption of the system audio output. According to a preferred embodiment of the present invention, the insertion and removal can be achieved noiselessly by providing means for routing the audio signal path to and from a recess and through its fully-installed module only after solid electronic contact between all module and recess contact elements has been established, and for routing the aduio signal path by the recess before the such contact between the elements is disturbed by removal. Sound modification also can be achieved without interruption by providing means for routing the audio signal path either around a recess, or to and from a recess via and through an installed cartridge. Thus, the present invention is primarily concerned with only two states or modes of operation, a bypass mode and an operative mode. And although because of the conjunctive working of two switches, these two modes are described in the basic embodiment in terms of three modes, in real effect there are but two.

For example, though switch 4 and switch 15 have been shown in the basic embodiment as conjunctively acting spring loaded momentary switches, this is not necessarily required to realize benefits of the present invention. It may be seen with reference to FIG. 8, that if the circuitry of switch 15 is removed from the system, and if switch 4 is without momentary bias springs so as to be a totally manually operated switch, then noiseless insertion of a module could be accomplished by an operator manually operating switch 4 in accordance with the teachings of the present invention. In other words, the audio effects circuit modules could be noiselessly inserted into and removed from the recess, and the audio signal path, without interruption of and without introducing spurious signals into the audio signal path if the operator always kept switch 4, as modified, in its bypass mode position until the module was fully inserted into the recess, and again placed switch 4 in its bypass mode position before removing the module from the recess.

Uninterrupted main signal path flow can also be provided by including means for maintaining continuity while the recess is empty, e.g. switch 15. Furthermore, such means for maintaining continuity can be utilized by itself to realize benefits of the present invention in accordance with the teachings herein. Accordingly, many of the same and similar functions of switches 4 and 15 for the system described hereinbefore may readily be seen by reference to FIGS. 10–23, wherein the elements are numbered with letter suffixes to essentially correspond to the elements of the basic embodiment of FIGS. 1–9.

Referring now to FIG. 10A, there is shown an electrical block diagram of a four recess system including recess bypass switching means 4*a* which performs functions similar to that of switch 4, which switch 4*a* can be in the form of a double pole double throw switch. The recess bypass switch 4*a* has a bypass mode and an operative mode of operation, the bypass mode operating to route the main audio signal path past the recess, and the operative mode operating to route the main audio signal path into and out of a recess 2 via and through a fully-installed module 3. In particular, as shown in FIG. 10A, each recess has associated therewith a recess audio signal input leg or line 13 and a recess audio signal output leg or line 19 of the audio path, and recess bypass switching means generally indicated as 4*a*. As described hereinbefore, and as shown in FIGS. 3–5, recess contact elements 16 are connected to recess junction pins or terminals 22, so that recess audio signal input terminal #22 input, as shown in FIG. 9, corresponds to an appropriate recess audio input contact element 16*i*, and recess audio signal output terminal #22 output corresponds to an appropriate recess audio output contact element 16*o*.

The bypass switching means 4*a* in FIG. 10A is shown as routing the audio signal path around the recess input and output contact elements 16*i*, 16*o* by respectively disconnecting the recess audio input and the output lines 13, 19 from the recess input and output contact elements 16*i*, 16*o*, and connecting the recess audio input and output lines 13, 19 directly together as shown in FIG. 10A. This bypass mode position is illustrated by switches 4*a*, 4*a*′, and 4*a*″.

Bypass switch 4*a* also has an operative mode of operation for operatively connecting the input and output lines 13 and 19 of the audio signal path to the recess input and output contact elements 16*i* and 16*o*, respectively, as illustrated by switch 4*a*‴ of FIG. 10A. Each of the modes may operate according to manual actuation of the switch by an operator, and independently of whether a module is inserted in the recess. As also mentioned hereinbefore, unlike switch 4, there is no spring loaded momentary action in switch 4*a*. In the operative mode, as shown at switch 4*a*‴, full insertion of a module 3 into the recess 2 provides and is coincident with a state of established electronic contact between the module contact elements 20*i*, 20*o*, and the recess contact elements 16*i*, 16*o* corresponding to terminals #22 input and #22 output of FIG. 9. The audio signal path is routed to and from the recess 2 via and through the fully installed and operative audio effects circuit module 3 to provide an audio effect.

The different modes of operation of the bypass switch 4*a* can be further understood by referring to FIG. 10, wherein there is shown a perspective view of a simplified embodiment of the invention showing the different physical positions of the bypass switches with respect to the different modes of operation of the bypass switch 4*a* of the system. The switches, may be similar to those shown in FIGS. 7*a*–7*i* except that they are non-momentary, and have a handle. The handle of the switch 4*a* is shown in the positions corresponding to the bypass mode for bypassing the recess (see 4*a*, 4*a*′, 4*a*″), and the operative mode for operatively routing the audio signal path into and out of the recess via and through the fully installed cartridge, as shown in FIG. 10A (See 4*a*‴).

As further shown in FIG. 10A, there is included a system bypass switch 8*a*, in the form of a double pole double throw switch, for routing the audio signal past all the recesses at the option of an operator. The main audio signal may be routed through one or more recesses and fully installed cartridges depending on the position of each of the switches 4*a*, or can be routed to completely bypass all recesses by placing switch 8*a* in the system bypass mode which connects the main incoming audio signal input to the system audio output. In FIG. 10A, switch 8*a* is shown in the operative mode of operation.

Also FIG. 10A discloses a system wherein both the recess input contact element 16*i* and recess output contact element 16*o* are disconnected from the main audio signal path, whereby the recess is completely remote from the rest of the system signals.

In an alternative embodiment of the simplified system similar to that shown in FIG. 10A, a four recess system is shown in FIG. 10B wherein there is provided a system in which each audio signal input line 13 is electrically connected to the recess input contact element 16*i* of each recess, and each audio signal output line 19 is electrically connected to single pole double throw bypass switches 4*b*, 4*b*′, 4*b*″, and 4*b*‴. The bypass switching means generally described as switch 4*b* has a bypass mode of operation for routing the signal path past the recess in the sense that the output contact element 16*o* is disconnected from the recess audio output leg 19 of each switch 4*b* and associated recess 2. Switch 4*b* has an operative mode of operation for operatively connecting the recess audio output line 19 of the audio signal path to the recess output contact element 16*o*, with each of the modes being operable and independent of whether a module is inserted into the recess.

As shown by the switch 4*b* in the various states or modes, 4*b*′, 4*b*″, and 4*b*‴, the switch can be used to bypass the recess as shown in 4*b*, 4*b*′, and 4*b*″.

In operation, the switch is placed in the bypass mode to route the main signal around the recess contact elements 16*i*, 16*o* so that until the module is fully installed, the audio signal bypasses the recess. After a module 3 is fully installed in the recess 2, so that a state of stabilized electronic contact exists between the module input and output contact elements 20*i*, 20*o* and the recess contact elements 16*i*, 16*o* respectively, the bypass switch 4*a* can be placed in the operative mode by an operator, as shown by switch 4*b*‴. The audio signal is thus routed to and from the recess via and through the fully inserted module by means of the operative mode of operation as shown in switch 4*b*‴. As further shown in FIG. 10B, there is included a system bypass switch 8*b* operatively connected to the system audio input signal path and the system audio output signal path. The system bypass switch 8*b* is shown as a single pole double throw switch. The states, or modes, of operation shown in FIG. 10B essentially correspond to those states shown in FIG.

10A, and to those shown in FIG. 10 with respect to the insertion of a module.

One significant advantage realized by the use of single pole double throw switches of FIG. 10B is that there are lesser component costs and lesser connections, and therefore lesser manufacturing costs. It should be noted that only the output contact element 16*o* is disconnected to effect signal bypass, and the input remains connected to the main audio signal path even when the bypass switch 4*b* is in the bypass mode.

As further shown in FIG. 10, in lieu of or in addition to the panel mounted switch 4*a* and 8*a*, there may be utilized a conventional foot switch unit 71*a*. It may have a foot switch 73*a* operating in the same manner as switch 8*a* to bypass all of the recesses 2, and have individual switches 72*a* corresponding to panel mounted switches 4*a* as shown in FIG. 10.

Referring now to FIGS. 10C–10J, there is shown an embodiment of a mechanism for automatically actuating the recess bypass switch 4*a* to prevent the bypass switch from being displaced from the bypass mode while a recess is devoid of a module for maintaining the continuity of the audio path. There is shown a switch-coupled bypass locking latch 25′ slidably mounted on control panel 30, similar to the latch of FIGS. 7*a*–7*a*. Handle 25*a* of recess bypass switch 4*a* projects through a hole 25*a*′ of locking latch 25′, so that actuation of the handle 25*a* of recess bypass switch 4*a* moves the locking latch 25′ back and forth between the bypass mode locking position shown in FIGS. 10C, 10E, 10F, and 10I, and the operative mode position shown in FIGS. 10D, 10G, 10H, and 10J. Switch 4*a* can be a single pole double throw, or double pole double throw non-momentary type switch.

Bypass locking latch 25′ has a one locking end having a slot 25*b*′. The slot is adapted to engage a detent pin 62 of a key 60 slidably mounted on an accommodatively extended side wall of the recess 2 (not illustrated as such herein), by means of a U-bracket 29′, similar to the latch 25 shown in FIG. 23A–23B. The key 60 has an actuation member 61 on one end thereof which protrudes slightly into the recess 2 far enough so that the member 61 is abutted by end portion 65 of a cartridge which has been inserted to a predetermined depth into the recess. The key 60 is resiliently biased toward the latch 25′ by biasing means 64, such as a pair of coiled springs attached to the key 60 and U-bracket 29′ as shown.

The bypass locking latch 25′ and key 60 provides that while the recess is devoid of a module, the handle 25*a* of bypass switch 4*a* is locked in the bypass mode of the key which is biased forward so that detent 62 engages slot 25*b*′, thereby blocking movement of recess bypass switch 4*a* into the operative mode and locking it in the bypass mode. Insertion of a cartridge 3 to a predetermined depth causes portion 65 of the cartridge 3 to abut protruding member 61 thereby moving key 60 and detent 62 out of slot 25*b*′, thus releasing and unlocking the switch-coupled latch 25′. At that point an operator is free to move the handle 25*a* of recess bypass switch 4*a* to its operative mode, provided the cartridge 3 has been fully inserted and installed into the recess to permit the locking latch 25′ to enter cartridge retaining notch 24 of the cartridge 3, as shown in FIG. 10H.

Thus it can be seen that the latch and key mechanism automatically ensures that recess bypass switch 4*a* will be in the bypass mode while the recess is empty, and that the switch cannot be moved to the operative mode until after the cartridge is fully installed. This assures noiseless insertion, while maintaining continuity of the audio signal path.

In another embodiment of the latch and key mechanism, a spring loaded bypass switch arrangement such as a switch-coupled latch and momentary switch 4 similar to that of the basic embodiment of FIGS. 7*a*–7*i*, could be utilized to move the switch into the operative mode automatically upon full insertion of the cartridge.

To remove the cartridge, the locking latch 25′ must be moved from the operative mode to the bypass mode to release the latch 25′ from the cartridge retaining notch 24. Removal of the cartridge to a predetermined depth of removal allows the key 60 and detent 62 to lockingly engage slot 25*b*′, and to return, by means of biasing means 64, to the locking bypass mode position as shown in FIG. 10E.

Referring now to FIGS. 11A and 11B there is shown a system having a plurality of recesses 2, each having a recess audio input contact element 16*i* and recess audio output contact element 16*o*. The recess contact elements 16*i*, 16*o* are connected respectively to a recess audio input leg 13 and recess audio output leg 19 of the main audio path. In FIG. 11A, there is shown a system bypass switch 8*a* associated with the audio path being in the form of a double pole double throw switch. Similarly, in FIG. 11B there is shown a series of four recesses being connected together, having a system recess bypass switch 8*b* being in the form of a single pole double throw switch. According to the teachings of the present invention, such a simplified system would accommodate noiseless and uninterrupted insertion if the operator of the system placed the system bypass switch in bypass during insertion and removal of an audio effects circuit module 3 into the recess 2. Audio signal processing can proceed only when all recesses 2 are each respectively occupied by fully installed and operative audio effects circuit modules 3 housed in cartridges 3*h*.

Referring now to FIGS. 12A–12B, there is shown a system having a series of four recesses 2, each being associated with switching means 15*c*, 15*d*, respectively for maintaining continuity when the recess is empty. Each recess has a recess audio input leg 13 and recess audio output leg 19, and is connected to recess audio input contact element 16*a* and output contact element 16*o*. The recess contact elements 16*i*, 16*o* are each connected to switching means 15*c* or 15*d*, shown as a single pole single throw switch. In addition, there is included a system bypass switch 8*a*, 8*b*, respectively, shown as a double pole double throw and single pole double throw switch, respectively. In operation, system bypass switch 8*a*, 8*b* is used to place the system in bypass while inserting or removing a module 3 into and from a recess 2, and to noiselessly route the audio signal through a recess only when a module 3 is installed therein. Switching means 15*c*, 15*d* associated with each recess is closed when the recess is empty or does not contain an operatively installed module, and this permits the signal to remain continuous between the recess audio input and output, even though one or more of the recesses is empty or devoid of a cartridge.

With reference to FIGS. 13A–13C, there is shown another embodiment of the system having only switching means 15*h*, shown as a single pole single throw switch, being connected to the recess to maintain a continuous flow of the audio signal when the recess is empty. A bypass switch is incorporated by means of a cartridge bypass switching means 4*a*, 4*b* being carried in the cartridge itself, as shown in FIGS. 13A and 13B. No recess bypass switch or system bypass switch is present. Cartridge bypass switch, 4*a*, 4*b* is mounted in the cartridge and electrically connected to cartridge audio input and output contact elements 20*i* and 20*o*, which correspondingly engage recess audio input and output contact elements 16*i* and 16*o*, when the cartridge is installed in the recess.

Placing the switch 15*h* in its closed position connects recess audio input 13 to output 19 as shown in FIG. 13C, and having the cartridge bypass switch 4*a*, 4*b* shown as a double pole double throw and single pole double throw switch, respectively, in its bypass mode, allows for noiselessly inserting the audio effects circuit into the main audio path, while maintaining continuity of the main audio path. Once the cartridge 3 is fully installed, wherein electronic contact is established between all corresponding contact elements, the switch 15*h* can be opened. The cartridge bypass switch 4*a*, 4*b* can then be placed in its operative mode directing the audio signal to flow to and from the recess via and through the audio effects circuit contained in the cartridge. In this manner, spurious signals are avoided and continuity is maintained. It may be seen that the effect of the cartridge bypass switch 4*a*, 4*b*, is to allow the cartridge to be connected to the system noiselessly, and in conjunction with switch 15*h* maintain the continuity of the audio path.

Noiselessly removing the audio effects circuit from the audio path while maintaining continuity of the audio path, is a reverse of the preceding, i.e., first placing the cartridge in its bypass mode, and then placing switch 15*h* in its closed position for noiselessly routing the audio signal by the recess. This avoids spurious noise signals that could otherwise be generated into the main audio path by disturbance to the electronic contact established between the corresponding contact elements which would otherwise be caused by removal of the cartridge.

With respect to switch 15*h* being a normally closed single pole single throw switch, such as or similar to that of switch 15 of FIG. 2 and FIG. 8, switch 15*h* can be positioned in the recess to automatically open after initial contact is made between the corresponding contact elements, and to close before such contact is broken, provided, that in each case, the cartridge bypass switching means is in its bypass mode at the proper time as previously discussed. This is in comparison to the action of the normally closed switch 15 in the basic embodiment of FIGS. 1–10, wherein normally closed switch 15 automatically opens before initial contact is made, since it is operating in conjunction with a momentary bypass switch 4 having already been displaced to its momentary, bypassed, position by the slight insertion of a module.

Although FIG. 14A can be considered as representative of the basic embodiment wherein the switches are manually operative and further inclusive of a system bypass switch 8*c* for routing the audio signal by all recesses all at once, FIGS. 14A and 14B are shown as an alternative embodiment of the simplified system wherein, in addition to bypass switching means 4*c*, 4*d* there is also included switching means for maintaining continuity when the recess is empty 15*c*, 15*d*, respectively. In the preferred embodiments described herein, such switching means generally referred to as 15, comprise a single pole single throw switch.

FIGS. 14A and 14B correspond to FIGS. 10A and 10B in the sense that FIG. 14B utilizes a double pole double throw switching system, and FIG. 14B utilizes a single pole double throw switching system. Therefore, many of the elements and comments with respect to FIGS. 10A and 10B would equally apply to FIGS. 14A and 14B, except for the addition of the switching means 15*c*, 15*d*. The switching means 15*c*, 15*d* in the embodiments illustrated comprises a single pole single throw switch, which if closed routes the audio signal past the recess 2, as in FIGS. 14A and 14B, when the recess 2 does not contain a fully-installed module 3, and which can be opened in response to full insertion of a module 3 into the recess 2, to route the audio signal path into and out of the recess 2 via and through its fully-installed module 3.

When bypass switch 4*c*, 4*d* is placed in the bypass mode, as shown at 4*c*, 4*c*′ of FIG. 14A, and 4*d*, 4*d*′ of FIG. 14B, the auto input line or leg 13 is connected through the switch 4*c*, 4*d* to the audio output line or leg 19 of each switching means associated with each recess, thereby routing the audio signal around the recess, irrespective of whether a module is fully inserted therein. When the bypass switch is placed in the operative mode as shown in 4*c*″, 4*c*‴ of FIG. 14A and 4*d*″, 4*d*‴ of FIG. 14B, switch 15*c*″ of FIG. 14A and 15*d*″ of FIG. 14B remains closed, thereby maintaining the continuity of the audio path while the recess is empty. The audio signal flows past the recess in the sense that the audio signal flows through the switch 15*c*″, 15*d*″ rather than flowing to and from the recess through recess contact elements 16*i*, 16*o*. This results in maintaining continuity of the audio signal without interruption.

Upon inserting a module to a predetermined point of full insertion, switching means 15*c*‴ of FIG. 14A, and 15*d*‴ of FIG. 14B, can be opened by mechanical or other means for detecting and indicating the full installation of a module in the recess, in which solid contact has been established between all corresponding module and recess contact elements. The audio signal is then, via the opened switch 15*c*‴, 15*d*‴ and the bypass switch 4*c*‴, 4*d*‴ placed in its operative mode, and routed to and from the recess via recess contact elements 16*a*, 16*o*, and through the now fully installed and operative audio effects circuit module 3 via module contact elements 20*i*, 20*o* to deliver the modified signal to the system output for producing the different sound effect output.

As further shown in FIGS. 14A and 14B, there is included the appropriate system bypass switches 8*c*, 8*d* for routing the audio signal path past all recesses.

Referring to FIGS. 15A–15C, there is shown a module 3 partially inserted in a recess 2 wherein a module board 90 is in the form of a printed circuit board having tracing contact elements indicated generally as 20. The corresponding recess contact elements 16 comprise the terminals of a connector 80, such as a conventional edge connector. As further shown in FIG. 15C, the edge connector contact elements 16 may comprise a pair of leaf springs which may provide the solid electronic and physical contact between all of the module contact elements 20 and recess contact elements 16. Audio input and output contact elements 20*i* and 20*o* of the cartridge correspondingly engage audio input and output contact elements 16*i* and 16*o*, and can be staggered with respect to the board edge as more fully explained hereinafter. As mentioned hereinbefore, other conventional types of connectors could be utilized other than edge connectors per se in carrying out the present invention.

Referring generally now to FIGS. 16–20, there are shown alternative embodiments of the present invention which may be utilized.

The cartridge audio input and outputs **20*i* and 20*o* are staggered and each set back from the edge 91 of the board 90 a predetermined distance so that the cartridge audio input and output contact elements 20*i* and 20*o* make contact and become electrically connected to the recess audio input and output contact elements 16*i* and 16*o* after electronic contact has been established between all other corresponding contact elements generally indicated as 16 and 20**. As mentioned earlier, such other contact elements include those providing DC power, control potentiometers, and the like, as required for the particular audio effects circuit which is housed in the cartridge. By connecting the audio input and output of the cartridge to the main audio path last, noiseless insertion of the cartridge is accomplished as discussed more fully hereinafter. Likewise, noiseless removal is also permitted since upon removal of the cartridge, the audio input and output of the cartridge are disconnected from the main audio path before disturbance to the electronic contact between the other contact elements, which disturbance would introduce spurious signals if the audio input and output were still connected to the main audio path.

In FIGS. 16 and 16A there is shown an embodiment of a switching means which provides substantially uninterrupted main audio signal flow automatically, and permits insertion of the audio effect circuit modules 3 into the main audio signal path without introducing spurious signals. As shown in FIG. 16, there is provided a connector 80 adapted to be mounted on the front side of far wall 26 of recess 2 for receiving an audio effects circuit module circuit board carried in an audio effects circuit module housing or cartridge **3*h*. The connector 80 is preferably similar to a conventional type edge connector as illustrated and described herein. Audio signal input leg 13 is connected to recess input contact element 16*i* of the edge connector, and audio signal output leg 19 is connected to a recess output contact element 16*o*. Recess contact element 16*o* is resiliently biased against recess input contact element 16*i* to function as a normally closed switch. The remaining recess contact elements are generally indicated as 16** and include DC power supply and circuit control terminals as and when required for operation of audio effects circuit modules as is known in the art.

FIG. 16 further discloses a partially sectioned top plan view of both sides of the effects circuit card 90 having module input contact element **20*i* mounted on one side thereof at a notched board portion 92, and having module output contact element 20*o* mounted on the opposite side of the board at notched portion 92. The remaining corresponding module contact elements are generally indicated as 20**, and would include corresponding power supply and circuit control terminals as appropriate.

Effect circuit card 90 has mounted thereon module contact elements generally designated as 20, so that they extend to the leading edge 91. As mentioned before, these elements 20 generally comprise the DC power terminals and other controls for the particular audio effects circuit which is carried on the circuit card. The module contact elements 20, **20*i*, and 20*o* correspond to and make corresponding contact or mate with recess contact element 16, 16*i*, and 16*o*, respectively. The notch portion 92 carrying contact elements 20*i* and 20*o* is located in the board such that it can be correspondingly engaged in between the biased pair of contact elements 16*i*, 16*o***.

Referring now to FIG. 16A, there is shown a diagrammatic representation of the switching mechanism illustrated in FIG. 16, which shows normally closed switch **15*e* corresponding to the recess contact elements 16*i*, 16*o* which are biased together to form the normally closed switch. As illustrated in FIG. 16A, upon insertion of the module 3 carrying the audio effects circuit board 90 into the recess 2, the notch leading edge 92*e*, shown as a mechanical switch opening mechanism 92*e* in FIG. 16A, opens the normally closed switch 15*e* formed by elements 16*i*, 16*o*, immediately prior to operable engagement of input contact elements 16*i* and 20*i*, and output contact elements 16*o* and 20*o*. There is substantially uninterrupted audio signal flow through switch 15*e* for maintaining continuity of the audio signal path at all times. Insertion of the module 3 into recess 2 allows all other module contact elements 20 to mate with corresponding recess contact elements 16, so that the power supply and other control contact elements have the first initial meeting or contact between all respective and corresponding contact elements while switch 15*e* is still closed, thereby preventing generation of spurious signals into the audio signal path. At a fuller depth of insertion, solid physical and electronic contact is established between all power supply and control contact elements 16 and 20, while the audio signal input and output contact elements 16*i*, 16*o*, 20*i*, and 20*o* are not yet mated. FIG. 16A** shows the system in such a state after said electronic contact has been established between all power supply and control contact elements.

The present invention recognizes problems associated with the real time insertion of an audio effect circuit module, housed in a cartridge, directly into a live audio signal path. For example, if the DC power required for an audio effects circuit is either abruptly applied or interrupted after the audio effects circuit audio signal input and output has been operatively inserted into the live audio signal path, there is an immediate generation and introduction of highly audible spurious signals into the audio signal path. Furthermore, untimely made connections of the control contact elements, such as potentiometers, could likewise cause spurious signals to be introduced into the signal path.

Accordingly, FIG. 16A shows the switching mechanism after solid and electronic contact has been made and stabilized between all contact elements, but immediately prior to the establishment of solid electronic contact between the audio signal input and output contact elements. The point at which spurious signals might otherwise be generated into the audio signal path are not present since switch **15*e* is still in its bypass or pass-it-by state, since 16*i*, 16*o* are still shorted together. Upon further insertion of the module into the recess, the notch leading edge 92*e* separates recess contact elements 16*i* and 16*o*, and opens the normally closed switch 15*e* immediately prior to operable engagement of the module input and output contact elements 20*i* and 20*o* with recess contact elements 16*i* and 16*o*, respectively. Operable engagement of the audio signal input and output contact elements 16*i*, 20*i* and 16*o*, 20*o*** is thus substantially noiseless, similar to a switch, since the audio effects circuit has already reached its steady state due to the fact that all other power supply and other effect circuit connections have already been solidly made.

FIGS. 17 and 17A are similar to the mechanism disclosed in FIG. 16 utilizing normally closed edge connector contact elements and an effects circuit card having notches therein for actuating the switching means, i.e., opening a normally closed switch after operable engagement of the edge connector power supply and board power supply contact elements, but prior to operable engagement between the recess and module input and output contact elements. In FIG. 17, a jumper j is connected to a recess contact element which is biased against element 16*i* and to a recess contact element which is biased to contact element 16*o*, to provide the normally closed switching mechanism for the audio signal path, via input and output legs 13 and 19, until insertion of a module. This embodiment is similar to that shown in FIG. 16, except that it utilizes two normally closed switches 15*f* to allow flexibility in that module input and output contact elements 20*i* and 20*o* can be placed on the same side of the board, instead of on opposite sides of the board as in FIG. 16. Subsequent to operable engagement of the power supply and control contact elements 16 and 20, the notch leading edge 92*f* opens the normally closed switching means 15*f*, as indicated by mechanism 92*f* in FIG. 17A, immediately prior to operable engagement between the audio signal input and output recess and module contact elements 16*i*, 20*i* and 16*o*, 20*o*.

In another embodiment, there is provided, as shown in FIGS. 18 and 18A, an edge connector 80 having audio input leg 13 connected to recess input contact element 16*i* and audio output leg 19 connected to recess output contact element 16*o*, A jumper wire is connected to element 16*i* and to recess contact element 16*o*' biased against 16*o* to form a normally closed switch 15*g*. Again, recess contact elements 16 for the necessary effect circuit power supply and control terminal connections are present.

In FIG. 18A, corresponding module board 90 has corresponding module contact elements 20 thereon, including module input 20*i* and module output 20*o*. The module board has a power supply and other control contact elements 20 and these elements extend to a leading edge 91 of the board. The board has a notch 92 therein located so that it corresponds to be operably engaged with the contact elements 16*o* and 16*o*'. The absence of the board edge at the notch portion 92 permits the normally closed switch 15*g* to remain closed until the board is solidly placed firmly into the edge connector 80, so that solid contact is established between all corresponding contact elements 20 and 16 except for elements 20*i*, 20*o*. After that condition is achieved, upon further insertion the normally closed switch 15*g* is opened by notch edge 92, shown as member 92*g* in FIG. 18A, for disconnecting the edge connector audio input 16*i* from the edge connector audio output 16*o*. This occurs subsequent to operable engagement of the edge connector power supply and control elements 16 with the corresponding board power supply and control elements 20, but prior to operable engagement between the corresponding audio signal input and outputs.

The actuating means, i.e., notch portions, include the module contact element 20*o* being set back a predetermined distance "b" from the notch leading edge 92*g* of the notch 92, which is itself set back a predetermined distance "a" from the leading edge 91 of the board. By aligning the contact elements 20*i* and 20*o* the same set back distance of "c" from the leading edge 92 of the board, the input and output 20*i* and 20*o* are connected at the same time to elements 16*i* and 16*o*. The gap "b" between notch leading edge 92*g* and the forward portion of element 20*o* should be sufficiently small so that there is substantially no humanly perceptible audible interruption in the audio signal path, i.e. sound output.

In an alternative embodiment as shown in FIG. 19, the module input contact element 20*i* may further be set in a distance "d" from the forward portion of the module output contact element 20*o*. This has the effect of connecting the module input 20*i* subsequent to the power supply and other contact elements 20, but prior to connection of the module output 20*o*.

In FIG. 20, there is shown an alternative embodiment wherein no notch is provided in the board 90, and the module input and output contact elements 20*i* and 20*o* are each set back the same distance "c" from the leading edge 91 of the board. The gap "c" and amount of set back of the contact elements 20*i* and 20*o* is in an amount sufficient to prevent the connection of the module and recess audio input and output contact elements while the normally closed switching means 15*g* is still closed to prevent feedback from the module output to the module input, but is a distance insufficient to permit substantial interruption in the audio signal which is readily perceptible to the listener of the audio effects in the live or recorded performance utilizing the system. Accordingly, it may be seen that various combinations of the embodiment presented herein may be utilized to effect the present invention.

Referring to FIGS. 21 and 22, in FIG. 21 there are shown as alternative embodiments wherein the audio input contact element 20*i* is set to the leading edge 91 of the board, so that audio output contact element 20*o* makes contact last, to route the audio signal through the audio effects circuit noiselessly. In FIG. 22, audio input and output contact elements 20*i* and 20*o* are both set to the leading edge 91 of the board. However, this embodiment should be utilized with a manual bypass switch to avoid noise and feedback from the module input to the module output.

Referring to FIGS. 23A and 23B, there is shown one embodiment of a removeable retaining means for retaining an inserted cartridge in a recess, which also permits the cartridge to be removed if desired. The retaining means may be a latch 25 as shown slidably coupled to control panel 30, having a handle 25*a*. The latch 25 is attached to U-bracket 29 by means of two pair of pins 29*b* of which one pair is fixed to the latch, and the other pair is fixed to the U-bracket. Biasing means 29*a*, such as a coil spring keeps the latch biased into the edge of the recess. When a cartridge is inserted, the latch is moved out of the way by the cartridge pressing on the quarter-rounded end of the latch. Once the cartridge is fully inserted, the biased latch springs back into the edge of the recess and into the locking-notch 24 of the cartridge. The cartridge is thus held firmly in place in the recess. Latch 25 is especially useful when the connectors utilized are of the point to point, spring loaded type as mentioned hereinabove, to assure fully stabilized contact is maintained while the cartridge is in the recess. Moreover, when spring loaded type connectors are used, manually moving the handle of the latch 25 releases the latch from the locking notch 24 thereby permitting partial expulsion by such connector spring action, and removal of the cartridge from the recess.

Since the present invention permits the arranging of the effects in series or parallel, as the case may be, in a particular serial order, different combined multiple effects on the audio signals and resulting sound outputs are produced, as is well known in the art. The embodiments disclosed herein permit the audio effects to be easily and conveniently changed and resequenced, by noiselessly inserting the desired audio effects circuit modules into the live audio path to produce any desired and combined sound outputs. For example, if the fuzz effect is preceded by a tone control effect in which the bass frequencies are filtered, then the treble strings on a guitar, for example, will be fuzzed more than the bass strings. A discussion of the different resulting sound effects which may be obtained by varying the sequence of the combined effects, is disclosed throughout the earlier mentioned reference book *Electronic Projects for Musicians*, by Craig Anderton, 1980 edition, especially at chapter 6 thereof.

Furthermore, it is recognized that some audio effects circuits require no source of power for operation, and are typically called "passive" circuits. One example is a passive tone control circuit as shown at page 73 of said book.

The present invention further presents a method of quickly and conveniently rearranging and substituting modules one for another to achieve a large number of unique arrangements of effects in a very short period of time. There are also advantages of compactness, portability, and minimal manufacturing cost by utilizing the audio effect circuit modules being housed in cartridges. In accordance with the present system, the modules may be noiselessly inserted in real time into the live audio signal path during operation of the system without interrupting the path or introducing spurious signals. Moreover, conventional prior art audio signal processing systems do not realize the benefits of the present invention in that there is nothing in the prior art which readily permits such substitution and resequencing of the audio effects in such a short period of time. It can readily be seen that the present system permits substitution in a time frame heretofore unheard of anywhere in the audio signal processing prior art. A user of the present invention utilizing only three modules A, B, and C, with, for example, but two recesses, could easily create six unique arrangments, namely AB, AC, BA, BC, CA, and CB very quickly. In addition, there are the three individual audio effects A, B, and C, for a total of nine different sound outputs not otherwise available in such a convenient and rapid manner. Thus, the noiseless and uninterrupted removal, rearranging, and substituting of the audio effects circuit modules can be accomplished quite rapidly. And, to calculate or arrive at the number of different sound outputs that can rapidly result from the use, for example, of four or more recesses, as disclosed herein, and the use of the wide variety of audio effects circuits already developed in the art, presents, at the least, the need for the use of mathematical formulae best found in the science or field of probability theory and statistics.

Although the present invention has been shown and described in terms of specific preferred embodiments, it will be appreciated by those skilled in the art that changes or modifications are possible which do not depart from the inventive concepts described and taught herein. Such changes and modifications are deemed to fall within the purview of these inventive concepts. Thus, it should be noted that the accompanying description and drawings are meant to describe the preferred embodiments of the invention, but are not intended to limit the spirit and scope thereof.

I claim:

1. An audio signal processing system for rapidly attaining a large number of different sounds resulting from facile insertion and removal of audio effects circuits into and from a live main audio path of said system, said system having an incoming source audio signal, said system being linkable to and operable in the audio path of any device adapted to receive an audio signal processing device, comprising:

at least one cartridge for containing said audio effects circuit and contact elements thereof serving as cartridge contact elements, said cartridge contact elements including at least one audio input and at least one audio output, whereby said audio output provides the audio effects;

a main housing having a system input terminal for connecting the incoming source audio signal to the audio path and having a system output terminal, said main housing further having at least one cartridge-receiving recess adapted to removeably receive said cartridge, said recess having recess contact elements adapted to correspondingly engage said cartridge contact elements when said cartridge is installed in said recess, said recess contact elements including at least one audio input and at least one audio output being respectively associated with said main audio path; and at least one recess bypass switching means associated with the main audio path and said recess for providing a bypass mode of operation wherein said bypass mode provides for electrically disconnecting said main audio path from said recess in a manner that provides for routing the audio path and, as a matter of course, the incoming source audio signal by said recess, and for providing an operative mode of operation wherein said operative mode provides for electrically connecting said audio path to said recess in a manner that provides for routing said audio signal to and from said recess via and through the audio effects circuit of a cartridge installed therein;

so that said modes can provide for avoiding spurious signals that can be generated into said audio path by the making or breaking of electronic contact between some of said corresponding contact elements while providing means for maintaining the continuity of said main audio path by, with respect to insertion of the audio effects circuit into said main audio path, first, before said insertion, placing said recess bypass switching means in said bypass mode of operation until, at a point reached during installation of said cartridge into said recess, stabilized electronic contact has been established between said corresponding contact elements, whereupon the placing of said switching means in said operative mode of operation can provide for noiselessly directing said audio signal to flow into and out of said recess via and through the audio effects circuit of the cartridge installed therein, while maintaining the continuity of said main audio path, and with respect to removal of the audio effects circuit from said audio path, by again first, before said removal, placing said recess bypass switching means in said bypass mode of operation, providing thereby, for noiselessly directing said audio signal to flow to said recess before disturbance to said stabilized electronic contact between said corresponding contact elements is caused by said removal, while maintaining the continuity of said main audio path;

whereby insertion and removal of the audio effects circuits into and from said main audio path can be accomplished in a manner permitting rapid and noiseless changing of said circuits to provide a large number of different sounds, while said system is in operation, while maintaining the continuity of said main audio path.

2. The system of claim 1, further comprising bypass locking means associated with said recess bypass switching means providing for automatically maintaining the continuity of said main audio path while allowing noiseless insertion and removal of said audio effects circuit into and from said main audio path, wherein said bypass locking means provides for the preventing of said placing of said recess bypass switching means into said operative mode while said recess is devoid of a cartridge by locking said recess bypass switching means in a locked bypass mode while said recess is devoid of a cartridge and until a cartridge is inserted into said recess to a predetermined depth of insertion whereupon, in response to and at said predetermined depth of insertion, said bypass locking means actuates said recess bypass switching means into an unlocked bypass mode allowing thereby for said placing of said bypass switching means into said operative mode when said cartridge is operatively installed in said recess, and for actuating said recess bypass switching means into said locked bypass mode in response to and at a predetermined depth of removal of said cartridge from said recess, said recess bypass switching means always being free to be brought to said bypass mode from said operative mode.

3. The system of claim 1, further comprising bypass locking means associated with said recess bypass switching means providing for automatically maintaining the continuity of said main audio path while allowing noiseless insertion and removal of said audio effects circuit into and from said main audio path, wherein said bypass locking means provides for the preventing of said placing of said recess bypass switching means into said operative mode while said recess is devoid of a cartridge by locking said recess bypass switching means in a locked bypass mode while said recess is devoid of a cartridge and until a cartridge is inserted into said recess to a predetermined depth of insertion whereupon, in response to and at said predetermined depth of insertion, said bypass locking means releases said recess bypass switching means from said locked bypass mode, said bypass locking means further including means for automatically placing said recess bypass switching means into said operative mode in response to said cartridge reaching an operatively installed position in said recess, and for actuating said recess bypass switching means into said locked bypass mode in response to and at a predetermined depth of removal of said cartridge from said recess, said recess bypass switching means always being free to be brought to said bypass mode from said operative mode.

4. The system of claim 1, further comprising a plurality of recesses being interconnected between said system audio input and said system audio output, and respective recess bypass switching means being associated with each said recess.

5. The system of claim 1 or 4, further including system bypass switching means for routing said audio signal by all said recesses all at once.

6. The system of claim 1, wherein said recess bypass switching means includes at least one double pole double throw switch.

7. The system of claim 1, wherein said recess bypass switching means includes at least one single pole double throw switch.

8. The system of claim 1 or 4, wherein said recess bypass switching means includes at least one foot switch.

9. The system of claim 1, further including means for removeably retaining said cartridge in said recess in said installed position.

10. The system of claim 1, further including means for providing electrical power to at least some of said recess contact elements.

11. An audio signal processing system for rapidly attaining a large number of different sounds resulting from facile insertion and removal of audio effects circuits into and from a live main audio path of said system, said system having an incoming source audio signal, said system being linkable to and operable in the audio path of any device adapted to receive an audio signal processing device, comprising:

at least one cartridge for containing said audio effects circuit and contact elements thereof serving as cartridge contact elements, said cartridge contact elements including at least one audio input and at least one audio output, whereby said audio output provides the audio effects;

a main housing having a system input terminal for connecting the incoming source audio signal to the audio path and having a system output terminal, said main housing further having at least one cartridge-receiving recess adapted to removeably receive said cartridge, said recess having recess contact elements adapted to correspondingly engage said cartridge contact elements when said cartridge is installed in said recess, said recess contact elements including at least one audio input and at least one audio output being respectively associated with said main audio path;

a plurality of said recesses being interconnected between said system audio input terminal and said system audio output terminal; and system bypass switching means associated with said main audio path and said plurality of recesses for providing a bypass mode of operation wherein said bypass mode provides for electrically disconnecting said main audio path from said plurality of recesses in a manner that provides for routing said main audio path and, as a matter of course, said incoming source audio signal by all of said recesses all at once, and for providing an operative mode of operation wherein said operative mode provides for electrically connecting said main audio path to said plurality of recesses in a manner that provides for routing said audio signal to and from said plurality of recesses via and through the audio effects circuit respectively of cartridges respectively installed in all of said recesses;

so that said modes can provide for avoiding spurious signals that can be generated into said main audio path by the making or breaking of electronic contact between some of said corresponding contact elements while providing means for maintaining the continuity of said main audio path by with respect to insertion of said audio effects circuit into said main audio path, first, before said insertion, placing said system bypass switching means in said bypass mode of operation until, at a point reached during installation of said cartridge into said recess, stabilized electronic contact has been established between said corresponding contact elements, whereupon, in that manner, having respectively provided each and every of said recesses with an installed cartridge, placing said system bypass switching means in said operative mode of operation provides for noiselessly directing said audio signal to flow through all of said audio effects circuits, while maintaining the continuity of said main audio path, and, with respect to removal of any of said audio effects circuits from said main audio path, by again first, before any of said removals, placing said system bypass switching means in said bypass mode of operation before disturbance to said stabilized electronic contact between said corresponding contact elements is caused by said removal, while maintaining continuity of said main audio path;

whereby insertion and removal of the audio effects circuits into and from said main audio path can be accomplished in a manner permitting rapid and noiseless changing of said circuits to provide a large number of different sounds, while said system is in operation, while maintaining the continuity of said main audio path.

12. The system of claim 11, wherein said system bypass switching means comprises a double pole double throw switch.

13. The system of claim 11, wherein said system bypass switching means comprises a single pole double throw switch.

14. The system of claim 11, wherein said system bypass switching means includes at least one foot switch.

15. The system of claim 11, further including means for removeably retaining said cartridge in said recess in said installed position.

16. The system of claim 11, further including means for providing electrical power to at least some of said recess contact elements.

17. An audio signal processing system for rapidly attaining a large number of different sounds resulting from facile insertion and removal of audio effects circuits into and from a live main audio path of said system, said system having an incoming source audio signal, said system being linkable to and operable in the audio path of any device adapted to receive an audio signal processing device, comprising:

at least one cartridge for containing said audio effects circuit and contact elements thereof serving as cartridge contact elements, said cartridge contact elements including at least one audio input and at least one audio output, whereby said audio output provides the audio effects;

a main housing having a system input terminal for connecting the incoming source audio signal to the audio path and having a system output terminal, said main housing further having at least one cartridge-receiving recess adapted to removeably receive said cartridge, said recess having recess contact elements adapted to correspondingly engage said cartridge contact elements when said cartridge is installed in said recess, said recess contact elements including at least one audio input and at least one audio output being respectively associated with said main audio path; and recess switching means associated with the main audio path and said recess for opening and closing a connection between said recess audio input and said recess audio output, wherein said closing provides for maintaining the continuity of said audio path while said recess is devoid of a cartridge;

a plurality of said recesses and respective recess switching means being interconnected between said system audio input terminal and said system audio output terminal; and system bypass switching means associated with said main audio path and said plurality of recesses providing a bypass mode of operation wherein said bypass mode provides for electrically disconnecting said main audio path from all of said recesses in a manner that provides for routing the audio path and, as a matter of course, the incoming audio signal by all said recesses all at once, and for providing an operative mode of operation wherein said operative mode provides for electrically connecting said main audio path to said plurality of recesses in a manner that provides for routing said audio signal to and from said plurality of recesses via and through the respective audio effects circuits of cartridges respectively installed therein;

so that said modes can provide for avoiding spurious signals that can be generated into said main audio path by the making or breaking of electronic contact between some of said corresponding contact elements while providing means for maintaining the continuity of said main audio path by, with respect to insertion of the audio effects circuit into said main audio path, first, before said insertion, placing said system bypass switching means in said bypass mode of operation, then placing said recess switching means in its opened position until, at a point reached during installation of said cartridge into said recess, stabilized electronic contact has been established between said corresponding contact elements, whereupon the placing of said system bypass switching means in said operative mode of operation provides for noiselessly directing said audio signal to flow into and out of said recess via and through the audio effects circuit of the cartridge installed therein, while maintaining the continuity of said main audio path, and with respect to removal of said audio effects circuit from said main audio path, by again first, before said removal, placing said system bypass switching means in said bypass mode of operation providing thereby for noiselessly directing said audio signal to flow by said recess before disturbance to said stabilized electronic contact between said corresponding contact elements is caused by said removal, and placing said recess switching means in its closed position prior to returning said system bypass switching means to said operative mode of operation for directing audio signal flow through the respective audio effects circuits of cartridges operatively installed in said recesses;

whereby insertion and removal of the audio effects circuits into and from said main audio path can be accomplished in a manner permitting rapid and noiseless changing of said circuits to provide a large number of different sounds, while said system is in operation, while maintaining the continuity of said main audio path.

18. The system of claim 17, wherein said system bypass switching means comprises a double pole double throw switch.

19. The system of claim 17, wherein said system bypass switching means comprises a single pole double throw switch.

20. The system of claim 17, wherein said recess switching means includes at least one single pole single throw switch.

21. The system of claim 17, wherein said recess switching means includes at least one normally closed single pole single throw momentary switch.

22. The system of claim 17, wherein said system bypass switching means includes at least one foot switch.

23. The system of claim 17, further including means for removeably retaining said cartridge in said recess in said installed position.

24. The system of claim 17, further including means for providing electrical power to at least some of said recess contact elements.

25. An audio signal processing system for rapidly attaining a large number of different sounds resulting from facile insertion and removal of audio effects circuits into and from a live main audio path of said system, said system having an incoming source audio signal, said system being linkable to and operable in the audio path of any device adapted to receive an audio signal processing device, comprising:

at least one cartridge for containing said audio effects circuit and contact elements thereof serving as cartridge contact elements, said cartridge contact elements including at least one audio input and at least one audio output, the audio output, whereby said audio output provides the audio effects;

a main housing having a system input terminal for connecting the incoming source audio signal to the audio path and having a system output terminal, said main housing further having at least one cartridge-receiving recess adapted to removeably receive said cartridge, said recess having recess contact elements adapted to correspondingly engage said cartridge contact elements when said cartridge is installed in said recess, said recess contact elements including at least one audio input and at least one audio output being respectively associated with said main audio path;

recess switching means associated with the main audio path and said recess for opening and closing a connection between said recess audio input and said recess audio output wherein said closing provides for maintaining the continuity of said audio path while said recess is devoid of a cartridge; and said cartridge having cartridge bypass switching means associated with said cartridge audio input and output for bypassin its audio effects circuit, said cartridge bypass switching means having a bypass mode and an operative mode of operation;

so that said recess switching means and said cartridge switching means can provide for avoiding spurious signals that can be generated into said audio path by the making or breaking of electronic contact between some of said corresponding contact elements while providing for maintaining the continuity of said main audio path by, with respect to insertion of the audio effects circuit into said main audio path, first, before said insertion, placing said recess switching means in its closed position and placing said cartridge bypass switching means in said bypass mode until, at a point reached during installation of said cartridge into said recess, stabilized electronic contact has been established between said corresponding contact elements, whereupon the sequence of first placing of said recess switching means in its opened position followed by the placing of said cartridge bypass switching means in said operative mode provides for noiselessly directing said audio signal to flow into and out of said recess via and through the audio effects circuit of the cartridge installed therein, while maintaining the continuity of said main audio path, and with respect to removal of the audio effects circuit from said audio path, by first, before said removal, placing said cartridge switching means in said bypass mode, followed by the placing of said recess switching means in its closed position provides for noiselessly directing said audio signal to flow by said recess before disturbance to said stabilized electronic contact between said corresponding contact elements is caused by said removal, while maintaining the continuity of said main audio path;

whereby insertion and removal of the audio effects circuits into and from said main audio path can be accomplished in a manner permitting rapid and noiseless changing of said circuits to provide a large number of different sounds, which said system is in operation, while maintaining the continuity of said main audio path.

26. The system of claim 25, further comprising a plurality of recesses being interconnected between said system audio input terminal and said system audio output terminal, and respective recess switching means associated with each said recess.

27. The system of claim 25, further including system bypass switching means for routing said audio signal by all said recesses all at once.

28. The system of claim 25, 26 or 27, wherein said recess switching means includes at least one single pole single throw switch.

29. The system of claim 25, 26 or 27, wherein said recess switching means includes at least one normally closed single pole single throw momentary switch.

30. The system of claim 25, 26 or 27, wherein said cartridge bypass switching means includes at least one double pole double throw switch.

31. The system of claim 25, 26 or 27, wherein said cartridge bypass switching means includes at least one single pole double throw switch.

32. The system of claim 27, wherein said system bypass switching means includes at least one foot switch.

33. The system of claim 25, 26 or 27, further including means for removeably retaining said cartridge in said recess in said installed position.

34. The system of claim 25, 26 or 27, further including means for providing electrical power to at least some of said recess contact elements.

35. An audio signal processing system for rapidly attaining a large number of different sounds resulting from facile insertion and removal of audio effects circuits into and from a live main audio path of said system, said system having an incoming source audio signal, said system being linkable to and operable in the audio path of any device adapted to receive an audio signal processing device, comprising:

at least one cartridge for containing said audio effects circuit and contact elements thereof serving as cartridge contact elements, said cartridge contact elements including at least one audio input and at least one audio output, whereby said audio output provides the audio effects;

a main housing having a system input terminal for connecting the incoming source audio signal to the main audio path and having a system output terminal, said main housing further having at least one cartridge-receiving recess adapted to removeably receive said cartridge, said recess having recess contact elements adapted to correspondingly engage said cartridge contact elements when said cartridge is installed in said recess, said recess contact elements including at least one audio input and at least one audio output being respectively associated with said main audio path;

recess switching means associated with the main audio path and said recess for opening and closing a connection between said recess audio input and said recess audio output wherein said closing provides for maintaining the continuity of the main audio path while said recess is devoid of a cartridge; and at least one bypass switching means associated with the main audio path and said recess for providing a bypass mode of operation wherein said bypass mode provides for electrically disconnecting said main audio path from said recess in a manner that provides for routing the main audio path and, as a matter of course, the incoming source audio signal by said recess, and for providing an operative mode of operation wherein said operative mode provides for electrically connecting said audio path to said recess in a manner that provides for routing said audio signal to and from said recess via and through the audio effects circuit of a cartridge installed therein;

so that said modes can provide for avoiding spurious signals that can be generated into said main audio path by the making or breaking of electronic contact between some of said corresponding contact elements while providing means for maintaining the continuity of said main audio path by, with respect to insertion of the audio effects circuit into said main audio path, first, before said insertion, placing said bypass switching means in said bypass mode of operation, then placing said recess switching means in its opened position until, at a point reached during installation of said cartridge into said recess, stabilized electronic contact has been established between said corresponding contact elements, whereupon the placing of said bypass switching means in said operative mode of operation provides for noiselessly directing said audio signal to flow into and out of said recess via and through the audio effects circuit of the cartridge installed therein, while maintaining the continuity of said main audio path, and with respect to removal of the audio effects circuit from said audio path, by again first, before said removal, placing said bypass switching means in said bypass mode of operation providing thereby for noiselessly directing said audio signal to flow by said recess before disturbance to said stabilized electronic contact between said corresponding contact elements is caused by said removal, and placing said recess switching means in its closed position by any time prior to returning said bypass switching means to said operative mode of operation for maintaining the continuity of said main audio path;

whereby insertion and removal of the audio effects circuits into and from said main audio path can be accomplished in a manner permitting rapid and noiseless changing of said circuits to provide a large number of different sounds, while said system is in operation, while maintaining the continuity of said audio path.

36. The system of claim 35, wherein said recess switching means includes means for automatically opening said connection between said recess audio input and said recess audio output in response to said cartridge being inserted into said recess to a predetermined depth of insertion, and for automatically closing said connection between said recess audio input and said recess audio output in response to said cartridge being removed from said recess to a predetermined depth of removal.

37. The system of claim 35, wherein said bypass switching means includes means for automatically placing said bypass switching means into said bypass mode of operation in response to said cartridge being inserted into said recess to a predetermined depth of insertion, and for automatically placing said bypass switching means into said operative mode of operation in response to said recess containing said cartridge operatively installed therein.

38. The system of claim 35, further comprising a plurality of recesses being interconnected between said system audio input terminal and said system audio output terminal, and said recess switching means and bypass switching means being respectively associated with each of said recess.

39. The system of claim 35, wherein said bypass switching means further includes system bypass switching means for routing said audio signal by all said recesses all at once.

40. The system of claim 35, 36, 37, 38, or 39, wherein said bypass switching means includes at least one double pole double throw switch.

41. The system of claim 35, 36, 37, 38, or 39, wherein said bypass switching means includes at least one single pole double throw switch.

42. The system of claim 35, 36, 37, 38, or 39, wherein said recess switching means includes at least one single pole single throw switch.

43. The system of claim 35, 36, 37, 38, or 39, wherein said recess switching means includes at least one normally closed single pole single throw momentary switch.

44. The system of claim 35, 36, 37, 38, or 39, wherein said bypass switching means includes at least one foot switch.

45. The system of claim 35, 36, 37, 38, or 39, further including means for removeably retaining said cartridge in said recess in said installed position.

46. The system of claim 35, 36, 37, 38, or 39, further including means for providing electrical power to at least some of said recess contact elements.

47. An audio signal processing system for rapidly attaining a large number of different sounds resulting from facile insertion and removal of audio effects circuits into and from a live main audio path of said system, said system having an incoming source audio signal, said system being linkable to and operable in the audio path of any device adapted to receive an audio signal processing device, comprising:

at least one cartridge for containing said audio effects circuit and contact elements thereof serving as cartridge contact elements, said cartridge contact elements including at least one audio input and at least one audio output, whereby said audio output provides the audio effects;

a main housing having a system input terminal for connecting the incoming source audio signal to the audio path and having a system output terminal, said main housing further having at least one cartridge-receiving recess adapted to removeably receive said cartridge, said recess having recess contact elements adapted to correspondingly engage said cartridge contact elements when said cartridge is installed in said recess, said recess contact elements including at least one audio input and at least one audio output being respectively associated with said main audio path; and at least one pair of said recess contact elements being constructed to further serve as at least one normally closed single pole single throw momentary switch associated with said audio path for opening and closing a connection between said recess audio input and said recess audio output, wherein said closing provides for maintaining the continuity of said main audio path while said recess does not contain a cartridge having its respective audio effects circuit operatively inserted into said main audio path, and wherein said opening permits operative connection of said main audio path to said audio effects circuit upon insertion of said audio effects circuit into said main audio path;

so that spurious signals that can be generated into said audio path by the making or breaking of electronic contact between some of said contact elements can be avoided by, with respect to insertion of said effects circuit into said audio path, connecting said main audio path to said cartridge audio contact elements via their respective electronic engagement with said recess audio contact elements after electronic contact has been established between all other said corresponding contact elements and said connection between said recess audio input and said recess audio output has been opened providing thereby for noiselessly directing the incoming audio signal to flow through said effects circuit, while maintaining the continuity of said main audio path, and, with respect to removal of said effects circuit from said audio path, disconnecting said main audio path from said cartridge audio contact elements via their respective electronic disengagement from said recess audio contact elements and closing said connection between said recess audio input and said recess audio output before disturbance to said established electronic contact between said other corresponding contact elements is caused by said removal, providing thereby for noiselessly directing said audio signal to flow by said recess, while maintaining the continuity of said main audio path;

whereby insertion and removal of said audio effects circuits into and from said main audio path can be accomplished in a manner permitting rapid and noiseless changing of said circuits to provide a large number of different sounds, while said system is in operation, while maintaining the continuity of said audio path.

48. The system of claim 47, further comprising a plurality of recesses and said respective normally closed single pole single throw switches being interconnected between said system audio input terminal and said system audio output terminal.

49. The system of claim 47, further including system bypass switching means for routing said audio signal by all said recesses all at once.

50. The system of claim 49, wherein said system bypass switching means includes at least one double pole double throw switch.

51. The system of claim 49, wherein said system bypass switching means includes at least one single pole double throw switch.

52. The system of claim 49, wherein said system bypass switching means includes at least one foot switch.

53. The system of claim 47, 48 or 49, further including means for removeably retaining said cartridge in said recess in said installed position.

54. The system of claim 47, 48 or 49, further including means for providing electrical power to at least some of said recess contact elements.

55. An audio signal processing system for rapidly attaining a large number of different sounds resulting from facile insertion and removal of audio effects circuits into and from a live main audio path of said system, said system having an incoming source audio signal, said system being linkable to and operable in the audio path of any device adapted to receive an audio signal processing device, comprising:

at least one cartridge for containing said audio effects circuit and contact elements thereof serving as cartridge contact elements, said cartridge contact elements including at least one audio input and at least one audio output, whereby said audio output provides the audio effects;

a main housing having a system input terminal for connecting the incoming source audio signal to the audio path and having a system output terminal, said main housing further having at least one cartridge-receiving recess adapted to removeably receive said cartridge, said recess having recess contact elements adapted to correspondingly engage said cartridge contact elements when said cartridge is installed in said recess, said recess contact elements including at least one audio input and at least one audio output being respectively associated with said main audio path;

sequentially staggered contact elements switching means comprising said corresponding recess and cartridge contact elements being respectively correspondingly staggered to provide a predetermined sequencing of their respective electronic engagement with and disengagement from each other by and during insertion and removal of said cartridge into and from said recess;

so that spurious signals that can be generated into the audio path by the making or breaking of electronic contact between some of said corresponding contact elements can be avoided by, with respect to insertion of said audio effects circuit into said main audio path, electrically connecting, via said staggering, said main audio path to said audio effects circuit via said recess audio contact elements after electronic contact has been established between all other corresponding contact elements, thereby providing for noiselessly inserting said audio effects circuit into said main audio path, and, with respect to removal of said audio effects circuit from said main audio path, electrically disconnected, via said staggering, said main audio path from said audio effects circuit before disturbance to said electronic contact between said other corresponding contact elements is caused by said removal, thereby providing for noiselessly removing said audio effects circuit from said main audio path.

56. A system according to claim 55, further including recess switching means being associated with said recess audio contact elements and said main audio path for closing of a connection between said recess audio input and said recess audio output for maintaining the continuity of said main audio path while said main audio path does not contain a said audio effects circuit inserted therein, and for opening said connection between said recess audio input and said recess audio output permitting the insertion of said audio effects circuit therein, said recess switching means automatically opening said connection between said recess audio input and said recess audio output in response to said cartridge being inserted into said recess to a predetermined depth of insertion, and said recess switching means automatically closing said connection between said recess audio input and said recess audio output in response to said cartridge being removed from said recess to a predetermined depth of removal;

whereby insertion and removal of the audio effects circuits into and from said main audio path can be accomplished in a manner permitting rapid and noiseless changing of said circuits to provide a large number of different sounds, while said system is in operation, while maintaining the continuity of said main audio path.

57. The system of claim 56, wherein said recess switching means includes at least one normally closed single pole single throw momentary switch.

58. The system of claim 55, further comprising a plurality of said recesses being interconnected between said system audio input and said system audio output.

59. The system of claim 55, further including system bypass switching means for rotating said audio signal by all said recesses at once.

60. The system of claim 59, wherein said system bypass switching means includes at least one double pole double throw switch.

61. The system of claim 59, wherein said system bypass switching means includes at least one single pole double throw switch.

62. The system of claim 59, wherein said system bypass switching means includes at least one foot switch.

63. The system of claim 55, further including means for removeably retaining said cartridge in said recess in said installed position.

64. The system of claim 55, further including means for providing electrical power to at least some of said recess contact elements.

65. A method for rapidly attaining a large number of different sounds in a system comprising a main audio path, a main housing for containing said main audio path, and having system audio input and output terminals respectively associated with said main audio path;

said main housing having a plurality of cartridge receiving recesses electrically interconnected between said system audio input and system audio output;

a plurality of audio effects circuits being respectively contained in cartridges adapted to be removeably received in any of said recesses;

said recesses and said cartridges respectively having a plurality of electrical contact elements including respective and corresponding audio inputs and audio outputs;

said recesses having respective electrical means being associated with said main audio path and with means for routing an incoming source audio signal either by said recesses or to and from said recesses via and through said audio effects circuits respectively contained in inserted cartridges, whereby said insertion of a cartridge into a recess provides disengageable connection of its audio effects circuit to said system; said method comprising the steps of:

(a) selecting one of said plurality of cartridges containing an audio effects circuit and inserting it into an empty one of said recesses to produce a different sound;

(b) selecting another of said plurality of cartridges containing a different audio effects circuit and inserting it into another one of said recesses so that there is a particular combination of said inserted cartridges to produce a first combined different sound;

(c) removing at least one of said inserted cartridges from its respective recess so that at least one of said recesses is empty; and (d) selecting at least one of said plurality of cartridges and inserting it into an empty one of said recesses so that there is a different particular combination of said inserted cartridges, to produce a second combined different sound;

(e) whereby said method provides for particular selection from, and particular combinational arrangements of, a wide variety of audio effects circuits for flexibly and rapidly attaining a large number of different sounds.

* * * * *